US008122931B2

(12) United States Patent
Lin

(10) Patent No.: US 8,122,931 B2
(45) Date of Patent: Feb. 28, 2012

(54) WINDOW COVERING

(75) Inventor: Tzong Fu Lin, Taipei (TW)

(73) Assignee: Whole Space Industries Ltd., Taipei (TW)

( * ) Notice: Subject to any disclaimer, the term of this patent is extended or adjusted under 35 U.S.C. 154(b) by 275 days.

(21) Appl. No.: 12/621,720

(22) Filed: Nov. 19, 2009

(65) Prior Publication Data

US 2010/0126678 A1 May 27, 2010

Related U.S. Application Data

(63) Continuation-in-part of application No. 12/503,333, filed on Jul. 15, 2009, which is a continuation-in-part of application No. 12/486,209, filed on Jun. 17, 2009, which is a continuation-in-part of application No. 12/390,952, filed on Feb. 23, 2009.

(60) Provisional application No. 61/118,227, filed on Nov. 26, 2008.

(51) Int. Cl.
*A47H 3/00* (2006.01)

(52) U.S. Cl. ..... 160/84.01; 160/243; 25/115 F

(58) Field of Classification Search ..... 160/84.04, 160/84.06, 178.1 R, 243, 173 R, 178.2; 24/115 F, 24/602, 667; 403/289, 290, 325, 327
See application file for complete search history.

(56) References Cited

U.S. PATENT DOCUMENTS

| | | | | |
|---|---|---|---|---|
| 1,321,800 | A | 11/1919 | Andress et al. | |
| 3,125,790 | A | 3/1964 | Gaylord | |
| 3,171,183 | A * | 3/1965 | Johnston | 24/635 |
| 4,909,298 | A | 3/1990 | Langhart et al. | |
| 5,533,559 | A | 7/1996 | Judkins | |
| 5,566,735 | A | 10/1996 | Jelic | |
| 5,630,458 | A | 5/1997 | Holden | |
| 6,431,248 | B1 | 8/2002 | Hyman et al. | |
| 6,484,787 | B1 | 11/2002 | Walters | |
| 6,637,493 | B1 | 10/2003 | Lampers | |
| 6,817,399 | B2 | 11/2004 | Berman et al. | |
| 6,845,803 | B1 * | 1/2005 | Nien | 160/178.1 R |
| 6,860,312 | B2 | 3/2005 | Judkins | |
| 6,918,425 | B2 | 7/2005 | Nien | |
| 6,948,546 | B2 | 9/2005 | Nien | |
| 7,000,672 | B2 | 2/2006 | Nien | |
| 7,086,446 | B2 | 8/2006 | Kollman et al. | |
| 7,117,918 | B2 | 10/2006 | Franssen | |
| 7,225,850 | B2 | 6/2007 | McCarty et al. | |
| 7,261,138 | B2 | 8/2007 | Judkins et al. | |
| 7,302,738 | B2 * | 12/2007 | Nien et al. | 24/115 F |
| 7,318,251 | B2 | 1/2008 | Lin | |
| 7,325,279 | B2 * | 2/2008 | Huang et al. | 24/115 F |
| 2004/0020604 | A1 * | 2/2004 | Allsopp | 160/84.04 |
| 2005/0022948 | A1 * | 2/2005 | Nien | 160/178.1 R |
| 2006/0144526 | A1 | 7/2006 | McGinley | |
| 2007/0023149 | A1 | 2/2007 | Lamars et al. | |

* cited by examiner

*Primary Examiner* — David Purol
(74) *Attorney, Agent, or Firm* — Buchanan Ingersoll & Rooney PC

(57) ABSTRACT

A window covering includes a plurality of lift cords extending from an upper rail and window covering material connected to the upper rail or the lift cords. A plurality of safety devices are attached to the window covering. Each safety device includes a male member and a female member. One of the members is attached to a respective lift cord and the other of the members is attached to an upper rail, a portion of the window covering material or a lower rail. The male and female members are configured to be attached together such that the male and female members separate from each other when a release force acts on at least one of the male member and female member.

20 Claims, 23 Drawing Sheets

FIG.5
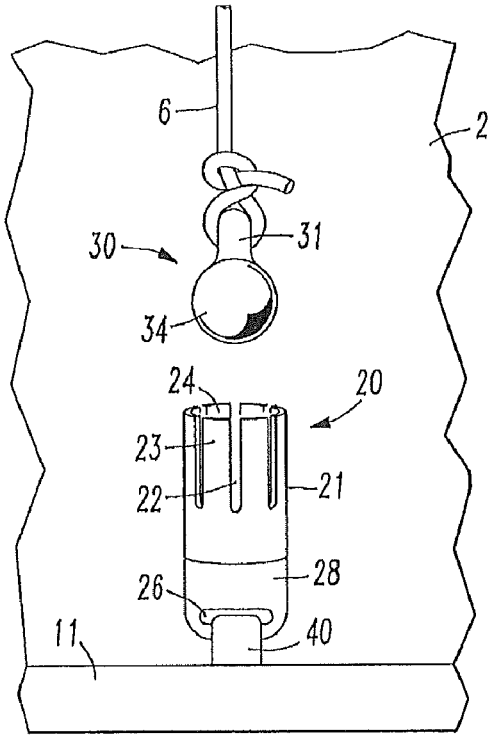
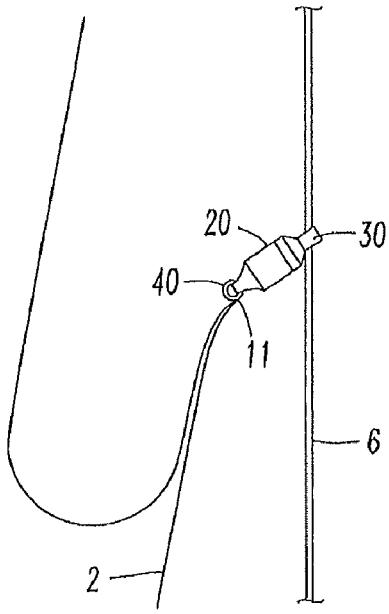
FIG.6

WINDOW COVERING

CROSS-REFERENCE TO RELATED APPLICATIONS

The present application is a continuation in part application of U.S. patent application Ser. No. 12/503,333, which claims priority to U.S. patent application Ser. No. 12/486,209, which claims priority to U.S. patent application Ser. No. 12/390,952. The present application also claims the benefit under 35 U.S.C. §119(e) of U.S. Provisional Patent Application Ser. No. 61/118,227 which was filed on Nov. 26, 2008.

FIELD OF THE INVENTION

This invention relates to window coverings such as Roman shades, and more particularly, to a child safety device and child safety kit that are used for such shades.

BACKGROUND OF THE INVENTION

One popular type of window covering is known as a Roman shade which may also be called a Roman blind, an Austrian shade, a Balloon Shade, or a Soft Shade. This type of shade consists of a panel or sheet of material attached along its top edge to a headrail and gathered at spaced intervals to provide a series of soft folds across the face of the fabric. Consequently, the typical Roman shade has a cascaded or softly pleated appearance. Such Roman shades are constructed so that when they are raised from an extended position, they gather from the bottom in generally horizontal folds or pleats until the entire shade resides near the top of the window covering in a retracted position. In some versions, the top of the window covering may also be lowered. The shades are operated by pulling on various lift cords which are used in conjunction with guides attached to the shade.

Most prior art Roman shades are formed either of a sheet of a flexible material such as a fabric or film or of a plurality of segments of material connected together. The material or interconnected segments are typically provided with a plurality of horizontal folds at points vertically spaced from one another to form folds when the shade is raised. A common method for making a Roman shade is to sew at least two sets of rings or connectors along vertical lines down the back of the fabric material as is shown in U.S. Pat. No. 1,321,800. The spacing of the rings or connectors affects the aesthetic effect of the shade and how the window covering material may look when being raised or lowered. Lift cords pass through the rings and each lift cord is attached to a bottom rail or the lowermost fold. Opposite ends of the lift cords are wound on a spool or shaft in the headrail. The spool or shaft may be turned by a cord loop device or a spring motor to raise and lower the shade. Alternatively, the lift cords may pass through a cord lock and be moved by a user to turn the spool or shaft.

The shade may also include spacer cords that pass through the rings. The spacer cords are typically attached to the headrail of the shade and the rings and are configured to help improve the aesthetic effect of the shade when the window covering material is raised or lowered.

Roman shades may be fabricated by fabricators to make a Roman shade in a custom size to fit a customer's window opening. Fabricators may mistakenly measure or determine the necessary length of the window covering material of a Roman shade or the desired positioning of the rings on the back of the window covering material. For instance, a fabricator may want to adjust the position of the rings to achieve a different aesthetic effect for the raising and lowering of window covering material after reviewing the look provided by the initial positioning of the rings. Since rings are often sewn or affixed to the window covering material, such repositioning can be difficult and time consuming.

Ribs, such as the ribs disclosed in U.S. Pat. No. 5,566,735, may be used by a fabricator instead of the rings to permit the fabricator to make adjustments to the locations of the ribs. The ribs may extend the width of the window covering material and are attached to spacer cords by fasteners. The ribs are configured to hold the window covering material at different spacing intervals and prevent the window covering material from falling vertically out of the ribs. The ribs are also configured to permit the material to be laterally slid out of the ribs so the positioning of the ribs can be changed by a fabricator. The spacing of the ribs acts similarly to the spacing of the rings and affects the look of the window covering material. For instance, spacing of the ribs can permit the material to have a cascading appearance when the shade is lowered and maintain this appearance when the shade is raised.

On occasion, children have been able to get behind a lowered Roman shade and become entangled in one of the lift cords. If the lift cord is around the child's neck and the child falls, the cord could act as a noose and strangle the child. Indeed, reports of such incidents have prompted a major retailer to issue a recall of one product line of Roman shades and the United States Consumer Product Safety Commission has issued a warning about the danger of child entanglement and hanging from the cords in Roman shades.

There have also been incidents of child entanglements in lift cords of venetian blinds and other types of window coverings. As a result, the art has developed various types of child safety devices that are intended to prevent deaths of children who become entangled in lift cords. For instance, U.S. Pat. Nos. 7,261,138, 7,225,850, 7,117,918, 7,086,446, 7,000,672, 6,948,546, 6,918,425, 6,860,312, 6,637,493, 6,484,787, 5,630,458, 5,533,559 and 4,909,298 disclose child safety devices for blinds. Child safety devices may be configured to keep the lift cords taught so that the cords cannot be pulled away from the window covering material and form a noose or release the cord from the shade when a child becomes entangled in the shade. Most, if not all of the cord release devices are not well suited for use on Roman shades. Moreover, many conventional child safety devices for blinds are visible from the front of the shade and detract from the aesthetic effect of the shade.

A new safety device is needed for Roman shades. Preferably, such a device can be sold in a kit to retrofit previously sold Roman shades or shades in a retailer's inventory. Moreover, such a safety device preferably does not detract from the aesthetic effect provided by the Roman shade.

SUMMARY OF THE INVENTION

An improved Roman shade is provided that includes a sheet of material connected to a headrail that is gathered at selected intervals to provide a series of transverse pleats or folds and lift cords for raising and lowering the shade. The Roman shade also includes a plurality of release devices attached to the sheet of material. Each of the release devices includes a male member and a female member releasably connected together. One of the members is attached to the sheet of material and the other member has an opening through which one of the lift cords pass. The male member and female member of each release device are sized and configured to separate when a release force acts on at least one of the female member and the male member.

Embodiments of my Roman shade can include cord operated Roman shades that have a cord lock attached to a headrail. The lift cords pass through the cord lock and may be raised or lowered to lift or lower the shade.

The female member of each release device may have various different configurations. In one embodiment, the female member may include a generally cylindrical body that defines an opening. The opening can be sized to receive and releasably hold a male member. The cylindrical body preferably has at least one slit formed in the body. The one or more slits may communicate with the opening. Other embodiments of my shade may include female members that have a body that defines an opening and a spring positioned in the opening. Preferably, the spring is a coil spring, a torsion spring, or an elastomeric spring.

It should be appreciated that embodiments of my Roman shade can include loops or rings attached to the sheet of material. Each female member may include a clip portion that is sized and configured to attach to one of the loops. The clip portion of the female member may be integral with a body portion of the female member.

Embodiments of my Roman shade may also include a bottom rail attached to the sheet of material and a plurality of receptacles attached to the bottom rail. The lift cords can be sized to extend to the bottom rail and each lift cord can have an end attached to a respective mateable body that is sized and configured to be inserted into an opening in at least one of the receptacles attached to the bottom rail. A releasable attachment is made after the mateable body is inserted into the opening in the receptacle. Release will occur when a predetermined release force acts on the mateable body. Preferably, the receptacles are female members and the mateable bodies are male members.

Some embodiments of my Roman shade include a plurality of loops attached to the sheet of material. The loops include a first series of rings that are aligned with each other and a second series of rings that are aligned with each other. A first lift cord may extend through the rings of the first series of rings and a second lift cord can extend through the rings of the second series of rings. The release devices may include a first series of release devices and a second series of release devices. Each release device of the first series of release devices can include a female member that is attached to a respective ring of the first series of rings to attach that female member to the sheet of material. Each release device of the second series of release devices may include a female member that is attached to a respective ring of the second series of rings to attach that female member to the sheet of material.

It should be understood that the sheet of material may be a fabric sheet, interconnected segments of material, a film, or a panel of woven wood or woven grass. The sheet of material may also include a series of bars or rods that are attached to the sheet of material or held within tubes or pockets sewn or otherwise formed in the sheet of material.

I additionally provide a Roman shade that includes a headrail, window covering material adjacent the headrail and a plurality of lift cords that extend from the headrail to the window covering material. Each lift cord is sized and configured to extend through one or more loops attached to the window covering material. The shade may be raised to retract the window covering material or lowered to extend the window covering material. A plurality of mateable bodies is also included in the Roman shade. Each mateable body is attached to one of the lift cords and is sized to pass through at least one of the loops. A plurality of receptacles are attached to at least one of a bottom portion of the window covering material and a bottom rail attached to a bottom portion of the window covering material. Each receptacle has an opening sized and configured to releasably hold one or more of the mateable bodies.

I further provide a Roman shade that includes a headrail, window covering material adjacent the headrail and a plurality of lift cords that extend from the headrail to the window covering material. Each lift cord is sized and configured to extend through one or more loops attached to the window covering material. The shade may be raised to retract the window covering material or lowered to extend the window covering material. A plurality of receptacles is also included in the Roman shade. Each receptacle is attached to one of the lift cords and is sized to pass through at least one of the loops. A plurality of mateable bodies are attached to at least one of a bottom portion of the window covering material and a bottom rail attached to a bottom portion of the window covering material. Each mateable body is sized to be releasably held within an opening of a receptacle.

In one embodiment of my window covering, each receptacle is a female member that includes a body that defines an opening sized and configured to receive a male member. Each male member includes a portion that is sized and configured to be releasably attached or received within the opening of the female member. The male member may include a cylindrical or polygonal shaped portion configured to be received within the opening of the female member. The body of the female member may be configured as jaws or a mouth and is resilient such that the jaws or mouth may retain a portion of the male member until a release force acts on the female member and causes the female member to release the male member.

An embodiment of my window covering includes a headrail, a plurality of lift cords that extend from the headrail, and window covering material connected to at least one of the headrail and the window covering material. The window covering material is moveable from a raised position to a lowered position. The window covering also includes one or more cord release devices attached to the window covering material. Each cord release device includes a clip portion, a first member, and a second member. The clip portion is attached to the first member and the second member. The first and second members are sized and configured to releasably interconnect such that the first and second members at least partially define an opening sized to receive and releasably retain at least one lift cord when the first and second members are interconnected and the first and second members are configured to separate and release the at least one lift cord when a release force exerted by one or more lift cords that are within the opening act on at least one of the first and second members.

The release force that is exerted by the one or more lift cords within the opening may be between 4.4 pounds and 6.6 pounds. Of course, the cord release devices may be configured so that a release for of less than 4.4 pounds, such as two pounds, may be exerted by the one or more lift cords to cause the first and second members to separate. The opening of each release device is preferably a generally circular opening configured to releasably retain at least one cord.

The first and second members may be configured to move away from each other in a direction that is transverse or perpendicular to the window covering material when the release force acts on at least one of the first and second members. Preferably, the first and second members and the clip portion are composed of a polymeric material and are integrally molded together.

The window covering material may include woven wood or woven grass that is collected into segments. Each segment may include a plurality of flexible elongated members that hold the woven wood or woven grass in that segment. The clip portion of the at least one cord release device can be attached to one of the flexible elongated members.

Embodiments of my window covering may include both one or more cord release devices and one or more release devices. Each release device may include a male member and a female member releasably connected together such that one member is attached to the window covering material and the other member has an aperture through which one of the lift cords pass. The male member and female member of each release device can be sized and configured to separate when a release force acts on at least one of the female and male members.

Embodiments of my window covering may also include an upper rail, window covering material adjacent to the upper rail, a plurality of lift cords that extend from the upper rail to the window covering material and a plurality of safety devices. The window covering can be moveable from a retracted position to an extended position. Each safety device includes a male member and a female member. One of the male member and the female member is attached adjacent to the lower portion of the window covering material and the other member is attached to a respective lift cord such that that member is attachable to the member attached adjacent to the lower portion of the window covering material. The male member and the female member are sized and configured such that a release force acting on the lift cord in a direction parallel to the window covering material and perpendicular to the lift cord causes the male member and the female member to separate.

The upper rail may be a headrail or a moveable intermediate rail of a top down bottom up shade. A lower rail may also be provided. The lower rail may be a bottom rail or a rail that is lower than the upper rail. In some embodiments, the lower rail may be a bar or a rod within a pocket defined in the window covering material or may be a rail or bar attached to the bottom of the window covering material.

Some embodiments of my window covering include safety devices that each has the female member attached to the lower portion of the window covering material and the male members attached to respective lift cords. The female members include a body that defines an opening configured to permit a release of the male member via a generally horizontal movement of the male member. The body of the female member may also define a gap positioned above the opening that is sized and configured to receive a portion of the lift cord attached to the male member.

The lift cords may include a first lift cord and a second lift cord. In some embodiments of my window covering, the first and second lift cords are end portions of one cord that extend from the upper rail. A middle portion of the cord may be attached to a lift mechanism, such as a spring motor, positioned within the upper rail or attached to the upper rail.

A window covering is also provided that includes an upper rail, window covering material adjacent to the upper rail, lift cords that extend from the upper rail to the window covering material, and a plurality of safety devices. Each safety device includes a male member and a female member. One of the male member and the female member are attached adjacent to the lower portion of the window covering material and the other member is attached to a respective lift cord such that that member is attachable to the member attached adjacent to the lower portion of the window covering material. The male member and female member are sized and configured such that a downward release force acting on the lift cord while the window covering is in a fully extended position causes the male member and female member to separate.

Preferably, the safety devices are configured such that the female members of the safety devices are attached to the lower portion of the window covering material and the male members are attached to respective lift cords. The female members can include a body having at least one protrusion configured to define or at least partially define a gap sized and configured to receive portion of a male member. The male member may include a first portion and one or more projections. Each of the projections configured to be received within a respective gap defined by a respective protrusion. The projections of the male member may include portions of a cylinder or bar portion of the male member that extend away from a central portion of the male member. The projections may also be prongs that extend from one or more sides of a portion of the male member.

Of course, embodiments of my window covering may also include one or more cord release devices. The cord release devices may be attached to the window covering material and may have an opening the lift cords pass through. The male member or female member of each safety device that is attached to the lift cord may also be sized and configured to pass through the opening of the cord release devices.

It should be appreciated that the window covering material may be composed of numerous different materials. For instance, the window covering material may be composed of woven wood or woven grass that is collected into segments, each segment having a plurality of flexible elongated members that hold the woven wood or woven grass in that segment. A clip portion of the one or more cord release devices may be attached to a flexible elongated member, such as a cord, wire, or ribbon.

It is also contemplated that safety devices may be attached to an upper rail or headrail of a window covering in addition to being attached to the window covering material. For example, one embodiment of my window covering may include a first set of safety devices attached to an upper rail and a second set of safety devices attached to the window covering material. Each first safety device may include a male member and a female member. One of the male member and the female member of each first safety device is attached to the upper rail and the other member is attached to a respective lift cord such that the member holding a lift cord is attachable to the member attached to the headrail. The male member and the female member of each first safety device are sized and configured such that a first release force acting on the lift cord causes the male and female members to separate. Each second safety device includes a male member and a female member. One of the male member and the female member of each second safety device is attached adjacent to the lower portion of the window covering material and the other member is attached to a respective lift cord such that the member holding the lift cord is attachable to the member attached adjacent to the lower portion of the window covering material. The male member and the female member of each second safety device are sized and configured such that a second release force acting on the lift cord causes the male member and female member to separate.

Preferably, the first safety devices are configured so that the male members are attached to the lift cords and the female members are attached to the upper rail such that the male member of the first safely device moves downward relative to the female member of each first safety device to separate. The female member of each second safety device is also preferably attached adjacent to the lower portion of the window covering material such that the female member of each second safety device moves downward relative to the male member of each second safety device to separate.

I also provide a kit for Roman shades that includes a plurality of male members and a plurality of female members. The female members or the male members are sized and configured for attachment to a sheet of material and the other members each have an opening sized and configured to receive a lift cord. Each of the female members are sized and configured to release one of the male members after that male member is releasably connected to that female member when a release force acts on at least one of that female member and that male member.

In some embodiments of my kit, each female member may include a body that has an opening sized and configured to releasably hold at least one of the male members. One or more slits may be formed in the body. The one or more slits can communicate with the opening.

In other embodiments of my kit, each female member includes a spring positioned in the opening of a body that is sized to receive at least one of the male members. Preferably, the spring is a coil spring, a torsion spring or an elastomeric spring positioned in the opening.

A kit for a Roman shade is also provided that includes at least one cord release device configured for attachment to window covering material of a Roman shade. Each cord release device includes a clip portion, a first member and a second member. The clip portion is attached to the first and second members. The first and second members are sized and configured to releasably interconnect such that the first and second members at least partially define an opening sized to receive and releasably retain at least one lift cord when the first and second members are interconnected. The first and second members are also configured to separate and release the one or more lift cord when a release force exerted by one or more of the lift cords that are within the opening act on at least one of the first and second members. Embodiments of my kit may also include one or more release devices, one or more mateable bodies, one or more receptacles or a combination of release devices, mateable bodies and receptacles.

Other details, objects, and advantages of the invention will become apparent as the following description of certain present preferred embodiments thereof and certain present preferred methods of practicing the same proceeds.

BRIEF DESCRIPTION OF THE FIGURES

Present preferred embodiments of my Roman shade having a child safety cord release and kit for providing a cord release on a Roman shade are shown in the accompanying drawings and certain present preferred methods of practicing the same are also illustrated therein.

FIG. 5 is top view of a first present preferred embodiment of my child safety cord release device in a separated position with the male portion connected to one end of a lift cord and the female portion connected to the shade material.

FIG. 6 is an enlarged side view of the first present preferred embodiment of my child safety cord release device connected between the shade material and a ring through which a lift cord runs.

DESCRIPTION OF PRESENT PREFERRED EMBODIMENTS

Figure 1:
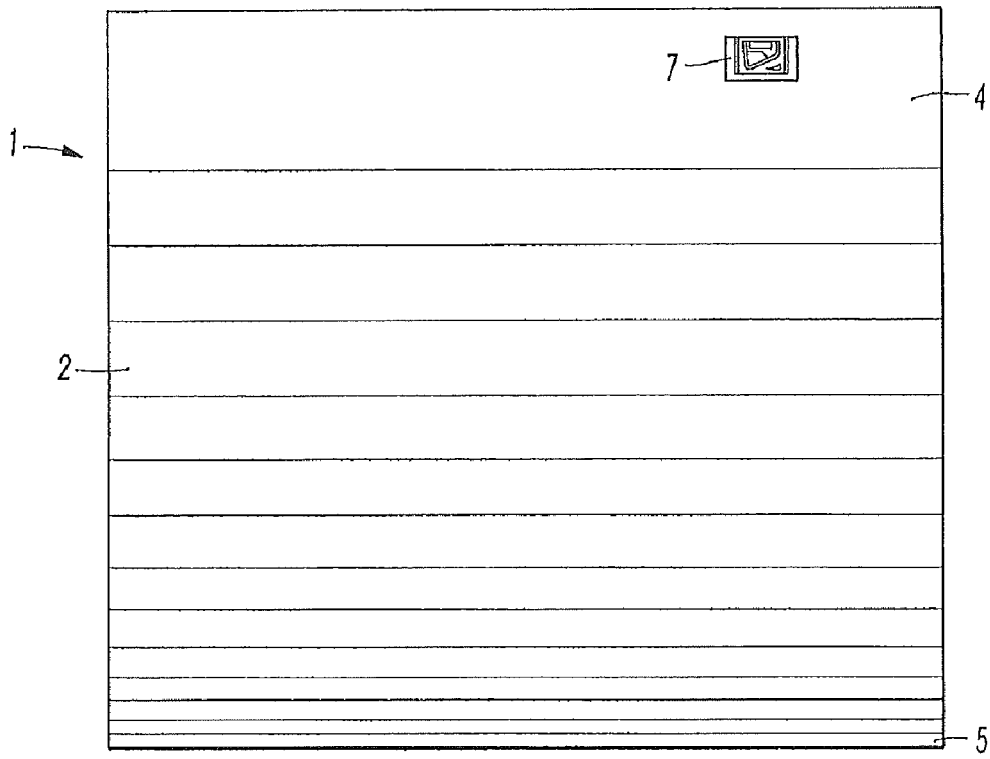
FIG. 1 is a front view of the present preferred embodiment of my Roman shade having a child safety cord release in a raised, or retracted, position.
Figure 2:
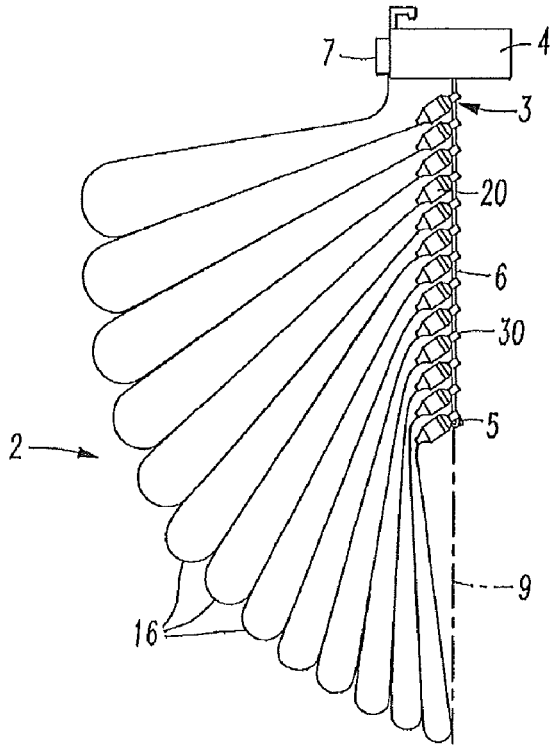
FIG. 2 is a side view of the embodiment shown in FIG. 1 in a raised position.
Figure 3:
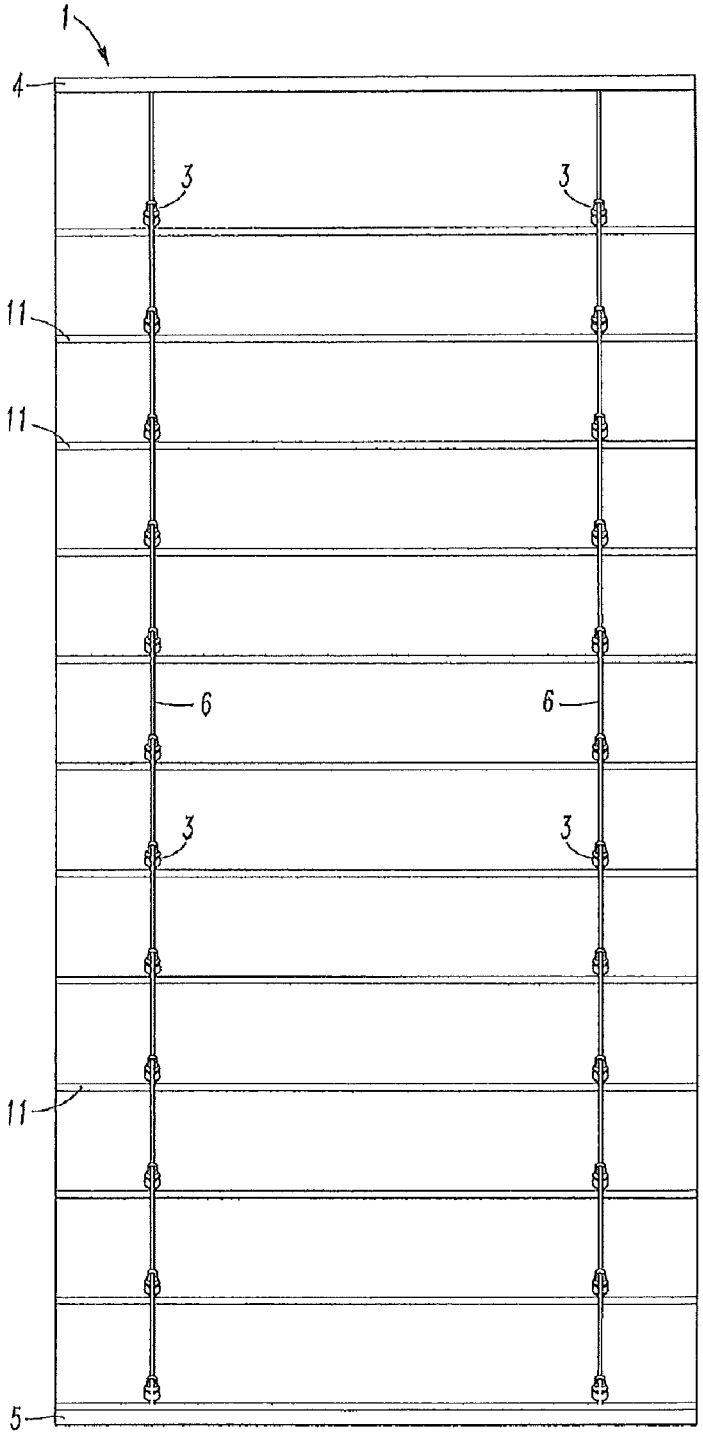
FIG. 3 is a rear view of the embodiment of FIGS. 1 and 2 in a fully lowered position.
Figure 4:
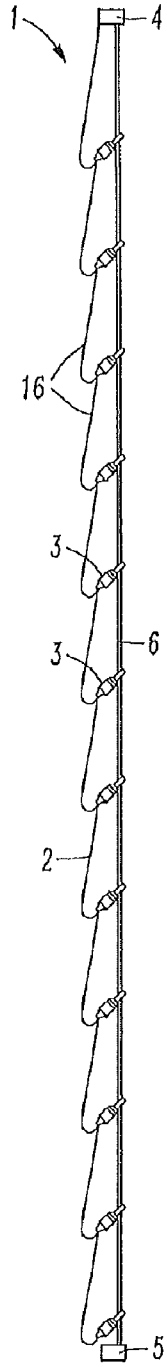
FIG. 4 is a side view similar to FIG. 2 showing the embodiment of FIGS. 1 thru 3 in a lowered, or extended, position.

Referring to FIGS. 1 thru 6, an embodiment of my Roman shade 1 with child safety cord release devices includes a sheet of fabric material 2 which is not pleated. A plurality of loops or rings is attached to the sheet of shade material 2. A top edge of the sheet of material 2 is connected to a headrail 4 and the bottom edge of the sheet of material 2 may be connected to a bottom bar or rail 5. The sheet of material 2 has a series of horizontal folds creating tabs 11 on the back of the shade. In some embodiments, each of the tabs 11 may include a rod or bar that is held within a pocket sewn into the sheet of material. The tabs 11 may define segments 16. The segments 16 could be made of separate strips of material with adjacent strips being sewn together at each tab 11. A skirt 9, shown in dotted line in FIG. 2 may extend from the bottom rail 5. Lift cords 6 pass through a cord lock 7, run down the back of the shade and are attached to the bottom bar 5.

Although I prefer that the sheet of shade material 2 be a woven or non-woven fabric, the sheet of material 2 could be a panel of woven woods, a panel of woven grasses or a film. The sheet of shade material 2 may include multiple interconnected segments of material or be a unitary sheet of material.

Cord release devices 3 are attached to the sheet of shade material 2. As may be best seen in FIGS. 2, 5 and 6, each release device includes a male member 30 and a female member 20. The male member 30 can have an elongated body 31 with a ball 34 at one end. The ball 34 may be spherical or polygonal in shape. I prefer that the ball 34 and opening 24 have a circular or oval cross-section through its longitudinal axis. However, the ball 34 and opening 24 may also have cross-sections that are square, rectangular, triangular or other polygon shapes.

The female member 20 has a generally tubular portion 21 having a series of longitudinal slits 22 creating a series of fingers 23 arranged side by side around a circle to form a basket. The slits 22 communicate with an opening 24 defined by the tubular portion. The opening 24 is sized to receive the ball portion 34 of the male member 30. The opening 24 may be a cavity that has a circular or oval cross-section along its longitudinal axis. Preferably the cross-section of the opening 24 along an axis normal to the longitudinal axis is circular. A tab portion 28 extends from the tubular portion 21 and has a slot 26 through which passes a loop 40 sewn in a tab 11 of the shade material 2 or other portion of the shade material 2. Loops 40 could also extend from the bottom rail 5.

As shown in FIG. 5, the male member 30 is attached to one end of the lift cord 6. The fingers 23 defined in the tubular portion 21 are sized and shaped to hold the ball 34 of the male member 30 securely enough that the connection will be maintained while the Roman shade is raised and lowered. However, should a child become entangled in the cord the male member will release from the female member.

Figure 7:
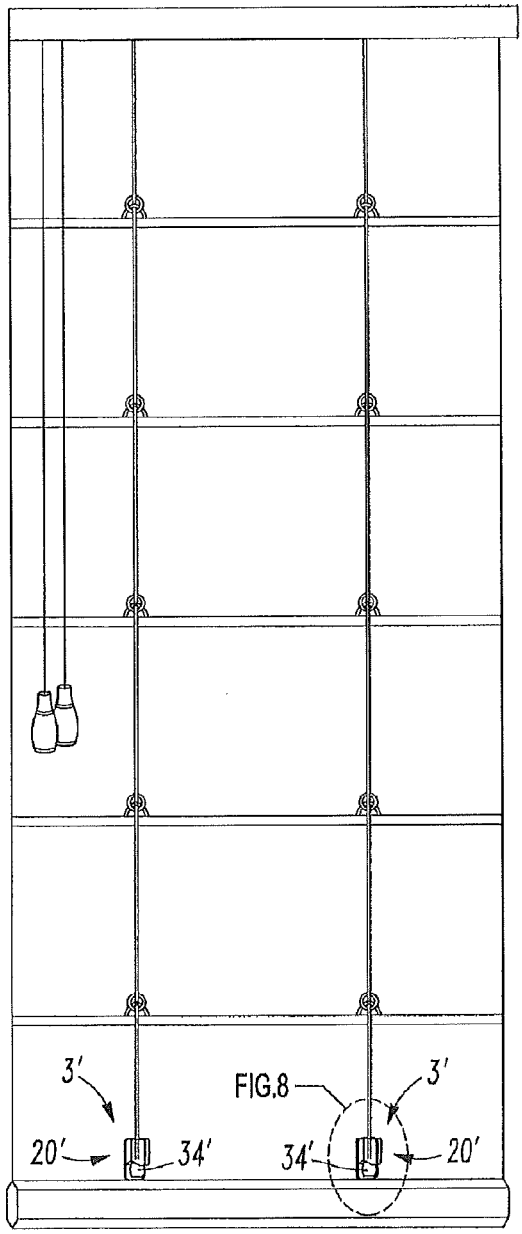
FIG. 7 is a rear perspective view of a second present preferred embodiment of my Roman shade.
Figure 8:
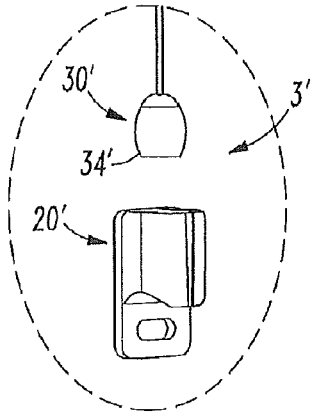
FIG. 8 is a fragmentary view of the second present preferred embodiment of my Roman shade illustrating the female and male members of the release device in a separated position.

One could provide only a limited number of cord release devices 3'. For instance, there could be a male member 30' that has a body 34' on an end of each lift cord that is releasably connected to a female member 20' attached to the bottom rail, as shown in FIGS. 7-8. In embodiments of Roman shades that only include two lift cords, only two release devices 3' would then be needed. However, I prefer to provide a cord release device on each ring or loop 40 the lift cords pass by, as may be appreciated from FIGS. 2, 5 and 6.

Preferably, both the male member 30 and the female member 20 of the release device 3 are made of the same material. Preferably, the members are composed of plastic such as ABS plastic. Of course, the male and female members could be made of any one of dozens of other plastics including polycarbonate, polyvinyl chloride and acetyl polymers. It is contemplated that the male and female member could also be composed of metal or other materials as long as the geometry of the parts is in accordance with the considerations mentioned below to account for the material's mechanical properties and dimensions of the parts.

There are several inter-related material properties and dimensions which determine the breakaway force, or release force. These include the flexural modulus of the material, tensile yield strength of the material, coefficient of static friction between the male member and the female member, thickness of the fingers, length of the fingers or slits, ratio of size of the cavity and the diameter of the ball end of the male member and the angle formed by a center line through the male member and a centerline through the female member.

It should be understood that a release device that has the male members configured to separate from the female members when three pounds more than the weight of the shade held by the lift cords act on at least one of the members of the release device can be provided. However, the cord release device can be configured to provide separation of the members at lower or higher release forces. For instance, the release force may be as low as two pounds or a force as high as twenty pounds. It should be understood that the "release force" is a force that is in addition to the weight of the shade material and other portions of the shade being held by the lift cords when the shade is mounted to a window opening. Preferably, each cord release device is designed for compliance with ANSI 2007 standard A1.3.4.4.2.3.4.

It is possible to adjust the release force by changing the size or configuration of the female members or male members. For instance, I have found that the release force can be changed by adjusting the length of the slits 22. Longer slits would cause the male members 20 to separate from the female members 30 at a lower force than shorter slits.

Figure 9:
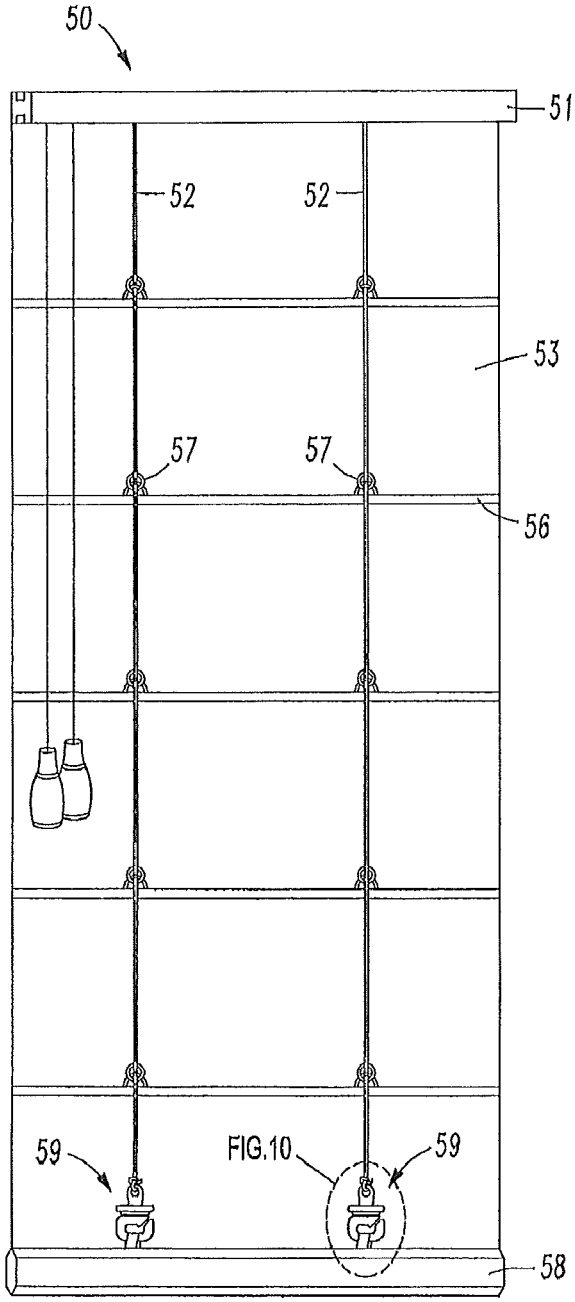
FIG. 9 is a rear perspective view of a third present preferred embodiment of my Roman shade.
Figure 10:
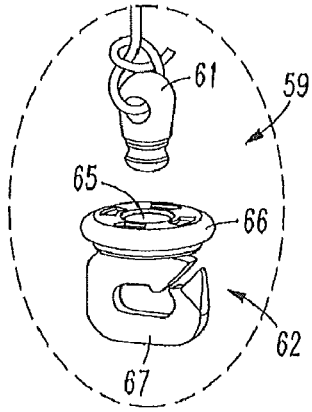
FIG. 10 is a fragmentary view of the third present preferred embodiment of my Roman shade illustrating the female and male members of the release device in a separated position.

A second present preferred embodiment of my Roman shade 50 is shown in FIGS. 9 and 10. The Roman shade includes a headrail 51, window covering material 53 that extends from the headrail to a bottom rail 58 and lift cords 52 that extend from the headrail 51 to the bottom rail 58. The lift cords 52 pass through rings 57 that are attached to the window covering material. The rings 57 are arranged in two series of rings 57 that are each vertically aligned with each other. Each lift cord 52 passes through a respective set of aligned rings 57. An end of each lift cord 52 is attached to a male member 61 of a release device 59, which is sized to pass through the rings 57. A female member 62 of each release device 59 is attached to the bottom rail 58. The male member 61 is releasably held within an opening 65 in a body portion 66 of the female member 62. A clip portion 67 of each female member is attached to a loop that extends from the bottom rail 58.

The release devices 59 are configured to release the lift cords 52 and male members 61 when a release force acting in an upward direction acts on the male members 61. Preferably, the release force is between three pounds and twenty pounds. The release force may also be between two pounds and twenty pounds. A spring (not shown) may be positioned within the opening 65 of each female member to configure the female member to release a respective male member upon an application of a particular release force. Preferably, the spring is a coil spring, an elastomeric spring or torsion spring. The spring may also be configured to receive a portion of the male member 61 and releasably retain that portion of the male member in the opening 65 until a release force acts on the male member.

Figure 11:
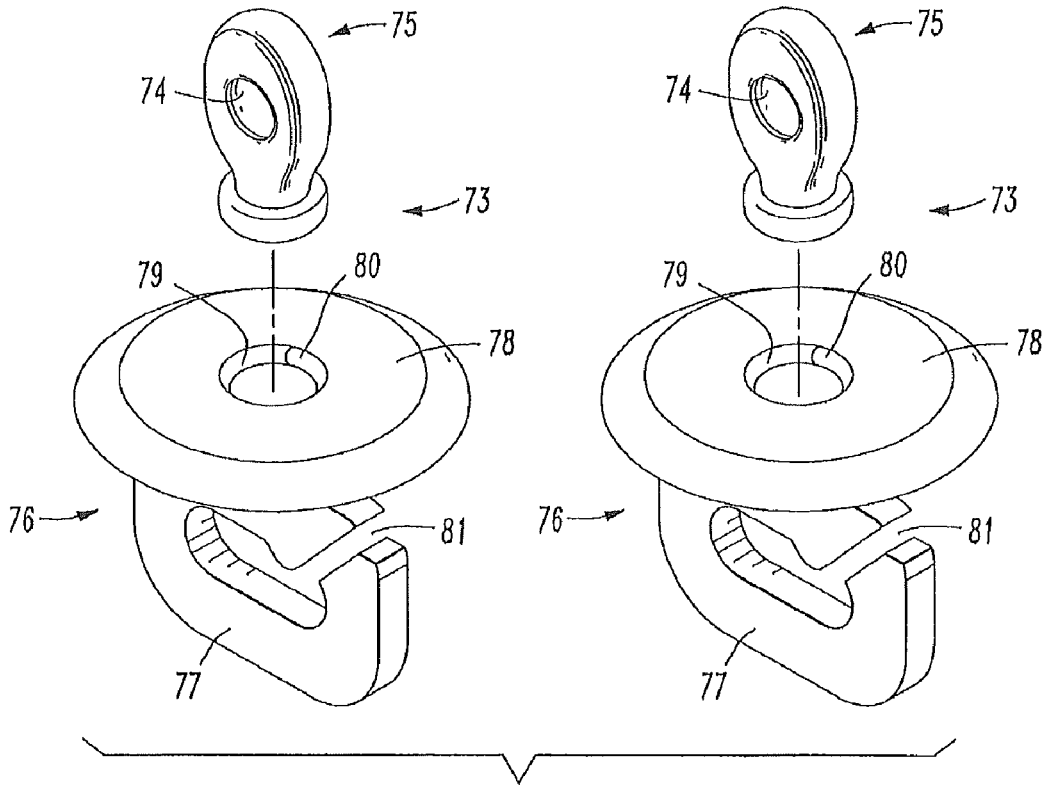
FIG. 11 is a perspective view of a first present preferred embodiment of my child safety kit.
Figure 12:
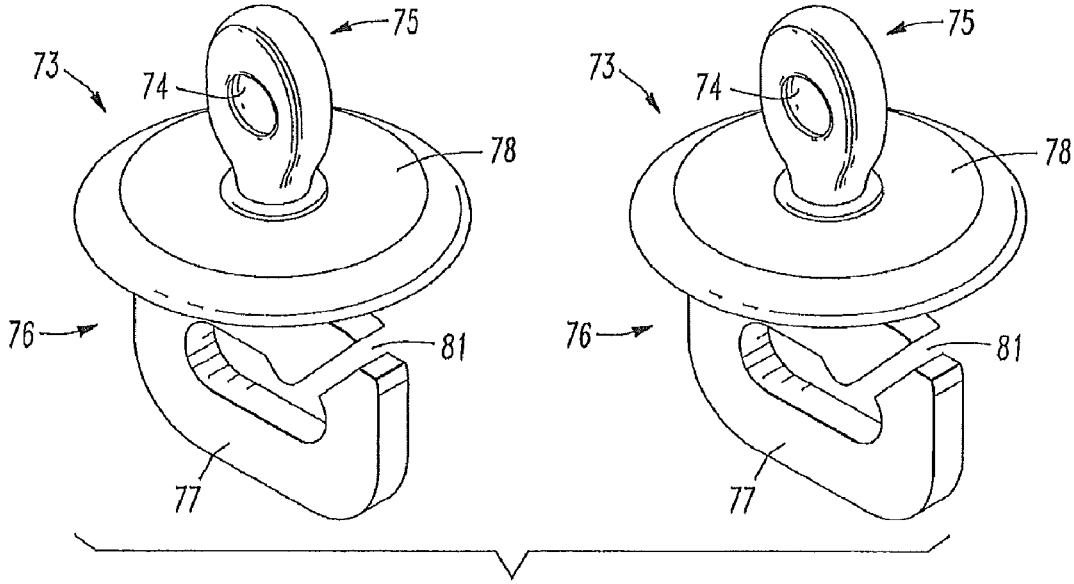
FIG. 12 is a perspective view of the first present preferred embodiment of my child safety kit with the female members and male members releasably connected.

A first present preferred child safety kit 71 is shown in FIGS. 11 and 12. The safety kit 71 includes a plurality of safety devices 73. Each of the safety devices 73 include a male member 75 and a female member 76. The male members 75 each have a body that defines an opening 74 to receive a lift cord. The female members 76 each include a clip portion 77 that is integral with a body portion 78. The clip portions 77 each define an opening 81 that is sized and configured to releasably attach to a ring or loop of a Roman shade. The body portion 78 of each female member 76 defines an opening 79. The opening 79 retains a spring 80. The spring is sized and configured to releasably retain a portion of the male member within the opening 79, as may be appreciated from FIG. 12. Preferably, the spring 80 is a coil spring, torsion spring or elastomeric spring. The male members 75 and female members 76 of the kit 71 may be sold or packaged separately or sold and packaged together. It should be understood that the male members 75 or female members 76 may be sized so that they can pass through rings or loops of a Roman shade.

Embodiments of my safety kit may be used to retrofit existing Roman shades to provide child safety features. For instance, the female members provided in embodiments of my kit may be attached to the bottom rail of a Roman shade or bottom portion of the shade material and the male members may be attached to the ends of lift cords. Such a retrofitted shade could appear similar to the second present preferred embodiment 51 shown in FIGS. 9 and 10.

Of course, embodiments of my safety kit may also include more than two safety devices. For instance, a user could provide a safety device on each loop or ring of a Roman shade such that each male member is attached to a lift cord and each female member is attached to respective loop or ring. As another example, each female member may be attached to one of the lift cords and a male member may be attached to a respective ring or loop.

Figure 13:
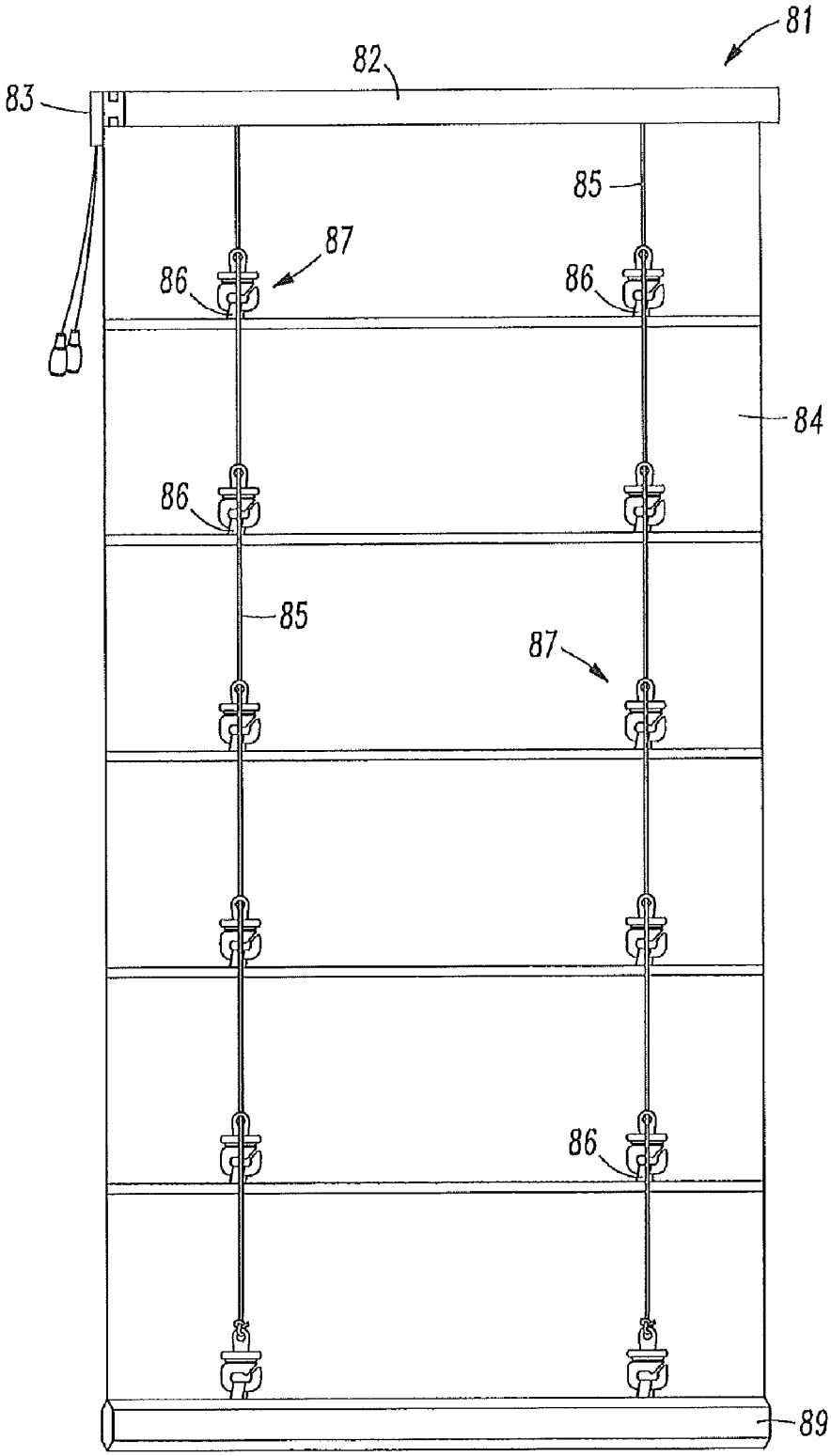
FIG. 13 is a rear perspective view of a fourth present preferred embodiment of my Roman shade.

Referring to FIG. 13, an embodiment of my Roman shade 81 can include a headrail 82 that is attached to a valance 83 and window covering material 84. The bottom portion of the window covering material is attached to a bottom rail 89. Each segment of the window covering material has a plurality of rings, or loops 86. The loops 86 include two sets of loops that are vertically aligned. A safety device 87 is attached to each loop 86. Each safety device includes a female member that is attached to the loops 86 and a male member that is releasably retained within an opening in the female member. Lift cords 85 extend from a cord lock (not shown) attached to the headrail 82. Each lift cord passes adjacent one set of vertically aligned loops to the bottom rail. The lift cords 85 pass through holes formed in the male members of the safety devices 87. The male member of each safety device may release from its respective female member independently of the other safety devices upon a release force acting on that male member.

Of course, other embodiments of my Roman shade may have release devices that include male members attached to the shade material or loops of the shade material and female members attached to the lift cords. Such an embodiment may be seen in FIG. 14, which illustrates a shade 103 that has male members 100 attached to the shade material 102 of the roman shade 103. The female members 104 each include an opening that is sized to receive a portion of a lift cord to attach the lift cord to the female member. Each female member 104 also has an opening sized and configured to releasably connect to a respective male member 100. The female member 104 will release the male member 100 when a release force acts on the female member, the male member, or both members.

Figure 15:
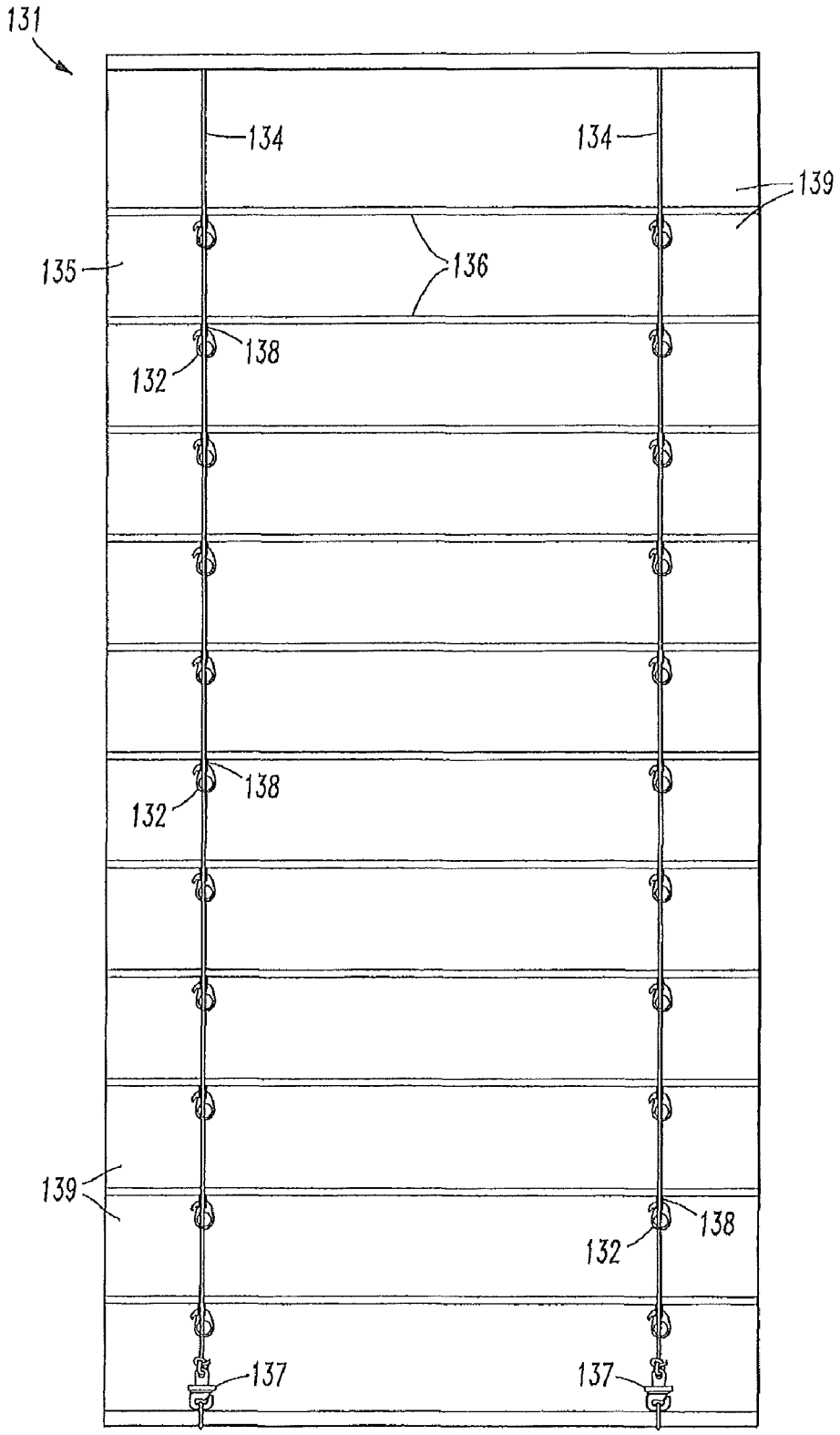
FIG. 15 is a rear view of a sixth present preferred embodiment of my Roman shade.

Referring to FIG. 15, a Roman shade 131 may also be provided with cord release devices 132 that are attached to the window covering material 135 of the shade. The window covering material 135 may include segments 139 that have transverse folds or pleats 136 formed at the interconnection of the segments 139. The shade 131 includes lift cords 134 that extend from the headrail of the shade 131 to a bottom segment of the window covering material 135. The lift cords 134 pass through openings in the cord release devices 132. Release devices 137 are attached to the bottom window covering segment.

The release devices 137 may be sized and configured to operate similarly to the release devices discussed above. Preferably, the release devices 137 each include a male portion that is attached to an end of a lift cord that is sized to pass through openings formed in the cord release devices 132. The male portion is also releasably attached to a female portion connected to the bottom segment of the window covering material 135.

The cord release devices 132 may be attached to the window covering material of the shade by having a clip portion attached to the window covering material by being attached to loops 138 or rings extending from the window covering material. The cord release devices are configured to release the lift cords after a release force acts on the lift cords. By releasing the lift cords, the cord release devices 132 can prevent the formation of loops that a child may become entangled in or strangled in.

Figure 16:
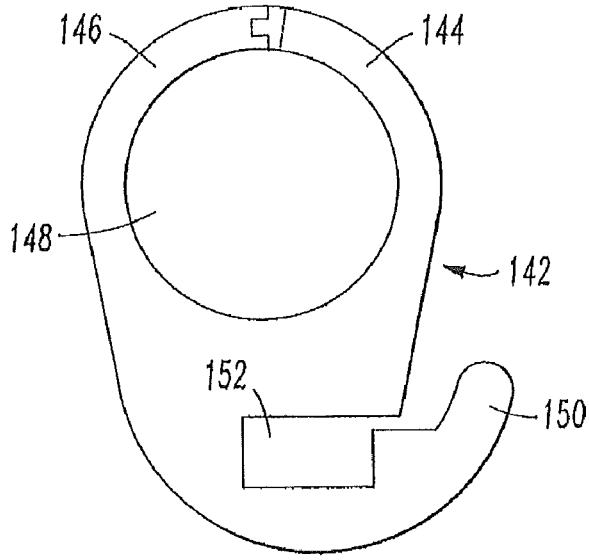
FIG. 16 is a top view of a first present preferred cord release device that has the first and second members in an interconnected position.
Figure 17:
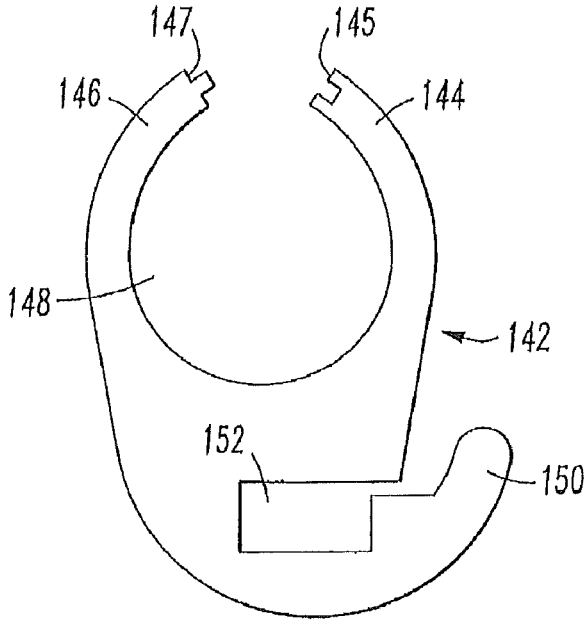
FIG. 17 is a view similar to FIG. 17 illustrating the first and second members separated from each other.
Figure 18:
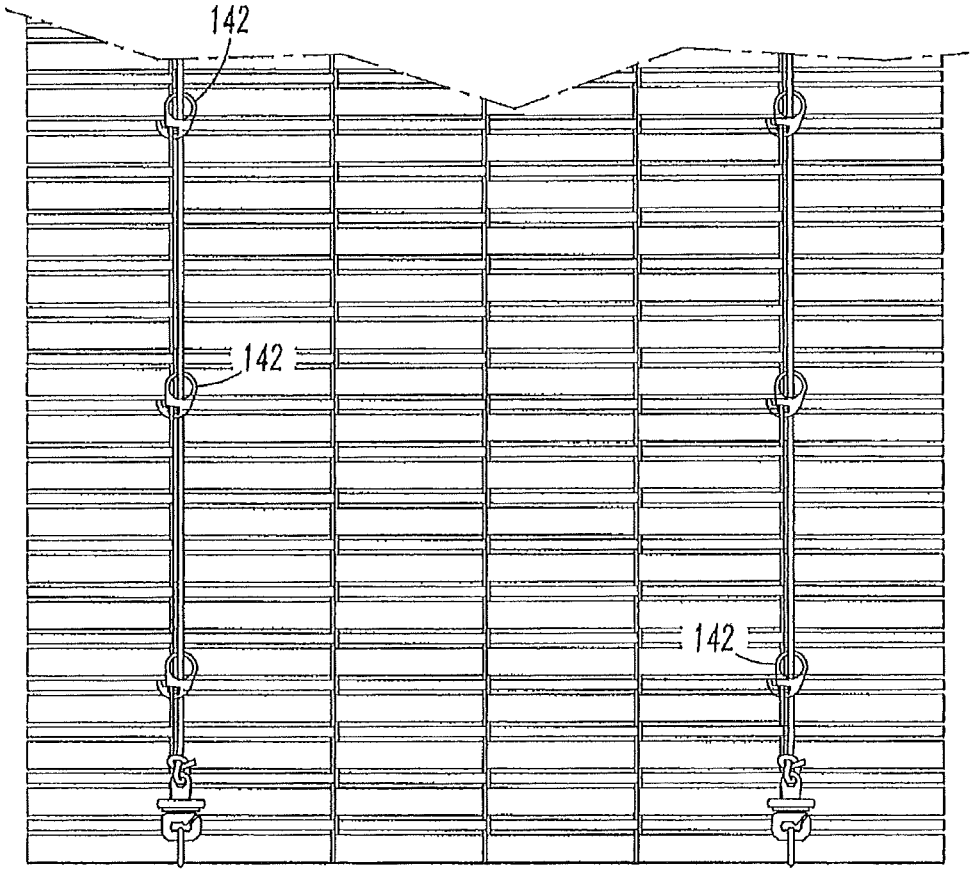
FIG. 18 is a fragmentary rear view of a present preferred window covering.
Figure 19:
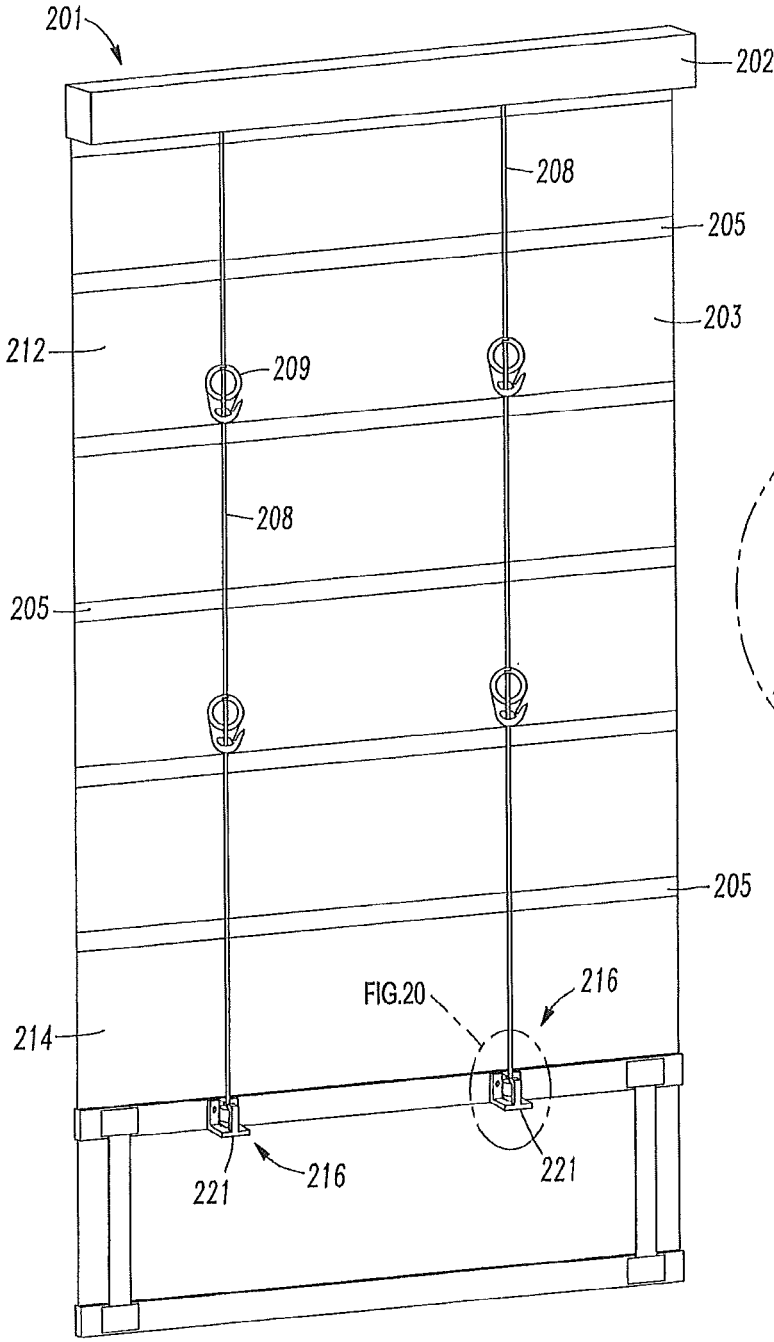
FIG. 19 is a rear perspective view of an eighth present preferred embodiment of my Roman shade.
Figure 20:
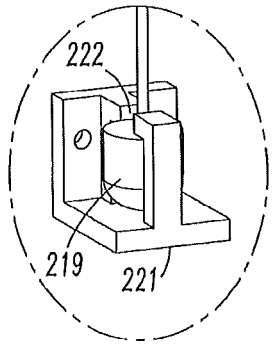
FIG. 20 is an enlarged view of a present preferred safety device used in the eighth present preferred embodiment shown in FIGS. 19 and 21.

Referring to FIGS. 16-17 cord release devices 142 may include a clip portion 150 that defines an opening 152 that is configured for attachment to rings or loops of a Roman shade. As may be appreciated from FIG. 18, the clip portion 150 may also be configured for attachment to cords, tape, or other flexible elongated members that may be used to collect woven wood or woven grass of a window covering material or window covering material segments. The clip portion 150 is attached to a first member 144 and a second member 146 that at least partially define an opening 148. The opening 148 is sized to receive or releasably retain at least one lift cord.

Figure 40:
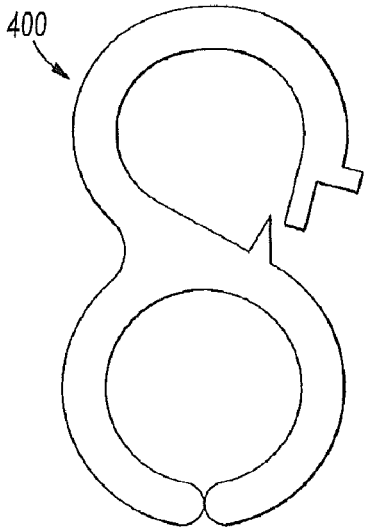
FIG. 40 is a top view of a second present preferred cord release device that has the first and second members in an abutting position.
Figure 41:
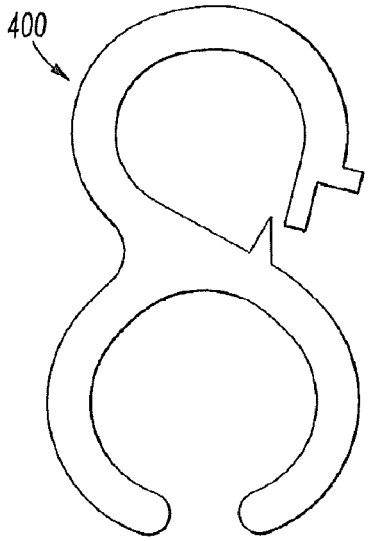
FIG. 41 is a top view of the second present preferred cord release device that has the first and second members in a separated position

The first and second members 144 and 146 may be configured so that their distal ends 145 and 147 abut one another to form opening 148 when no force is acting on either member 144, 146. Alternatively, these ends may overlap one another as indicated by the dotted line in FIG. 16. Either interconnection will cause the members 144 and 146 to completely encircle opening 148. Alternatively, the first and second members may have their distal ends abut one another as shown in the cord release device 400 shown in FIGS. 40 and 41. It is contemplated that the members of the cord release device 400 may separate upon a release force of between 2 pounds and 6.6 pounds.

Preferably, the first and second members 144 and 146 and the clip portion 150 are integrally molded as a unitary structure and are composed of a polymeric material, such as plastic, polycarbonate or ABS. Most preferably, the material of the cord release device 142 is clear so that the impact the device may have on the aesthetic effect of the shade is minimized.

The first and second members 144 and 146 are configured to separate when a release force acts on the members 144 and 146, as may be seen in FIG. 17. When the first and second members 144 and 146 are separated, a lift cord retained within the opening 148 may pass out of the opening 148. After the release force stops acting on the members, the first and second members may move back into an interconnected position, as shown in FIG. 16, due to the size, configuration or resiliency of the members.

Preferably, the first and second members are configured to separate upon a release force that acts transverse or perpendicular to the window covering material of a shade. The release force may be exerted through or by one or more lift cords positioned within the opening defined by the first and second members.

When a force acts on one or both members 144 and 146, ends 145 and 147 may separate from one another by moving one or more different directions. They may move in a direction that is within a plane passing through the two members. They may move in a direction that is perpendicular to the plane passing through the two members. Or they may move in both directions. Furthermore, only one end 145, 147 need move to release the cords.

The first and second members 144 and 146 may be configured to separate upon different release forces. Preferably, the first and second members are configured to separate when a force that is less than 10 pounds, but greater than 4 pounds acts on the members. It is also contemplated that the release force may also be between two pounds and ten pounds or 4.4 pounds and 6.6 pounds.

The release force of the cord release device 142 may be determined by securing the device 142 so that it is stationed in one place and does not move. A cord can then be inserted into the opening 148 and made it into a loop with a tied end. The cord may then be pulled to determine that amount of force, or weight, that must be exerted until the cord is released from the opening 148. The amount of the force being applied to the cord can be measured during the pulling of the cord to determine the amount of the release force.

It should be understood that cord diameters can affect the amount of the release force necessary to separate the first and second members 144 and 146. For instance, I have found that a cord that is 1.8 millimeters (mm) to 2.4 mm require a maximum of 5.5 pounds of force before the cord is released from the opening 148. Thinner cords, such as cords with a diameter of 1.5 mm, may only need 4.4 pounds of force to separate the first and second members 144 and 146 and release from the opening 148. It is also contemplated that the first and second members 144 and 146 may be configured to separate to release a lift cord upon a release force of less than 4.4 pounds, such as two pounds or three pounds.

It should be appreciated that embodiments of my safety kit may use one or more cord release devices, such as cord release devices 132 or 142. The cord release devices may be sold separate from the safety devices or release devices or may be sold together with those safety devices. Further, embodiments of my safety kit may only include one or more cord release devices 142 or 132.

Referring to FIGS. 19-22, a present preferred embodiment of a window covering 201 may include an upper rail or headrail 202 and window covering material 203 positioned adjacent to the headrail 202. The window covering material includes an upper portion 212 and a lower portion 214. The window covering material 203 is comprised of segments that each include a bar or rod 205 positioned within a pocket defined in the segment. Lift cords 208 extend from the headrail 208 to the lower portion 214 of the window covering material. The lift cords 208 pass through openings of cord release devices 209 attached to the window covering material 203. The end of each lift cord is attached to a male member 219 of a safety device 216. Each safety device 216 also has a female member 221 attached to the lower portion 214 of the window covering material. Each female member 221 has an opening sized and configured to receive the male member 219 such that a release force, indicated by arrow F in FIG. 21, acting on the lift cord in a direction parallel to the window covering material and perpendicular to the lift cord can cause the male member 219 to move horizontally and release from the opening formed in the female member 221. The female member 221 is configured to retain the male member against forces acting in a vertical or substantially vertical direction.

Figure 21:
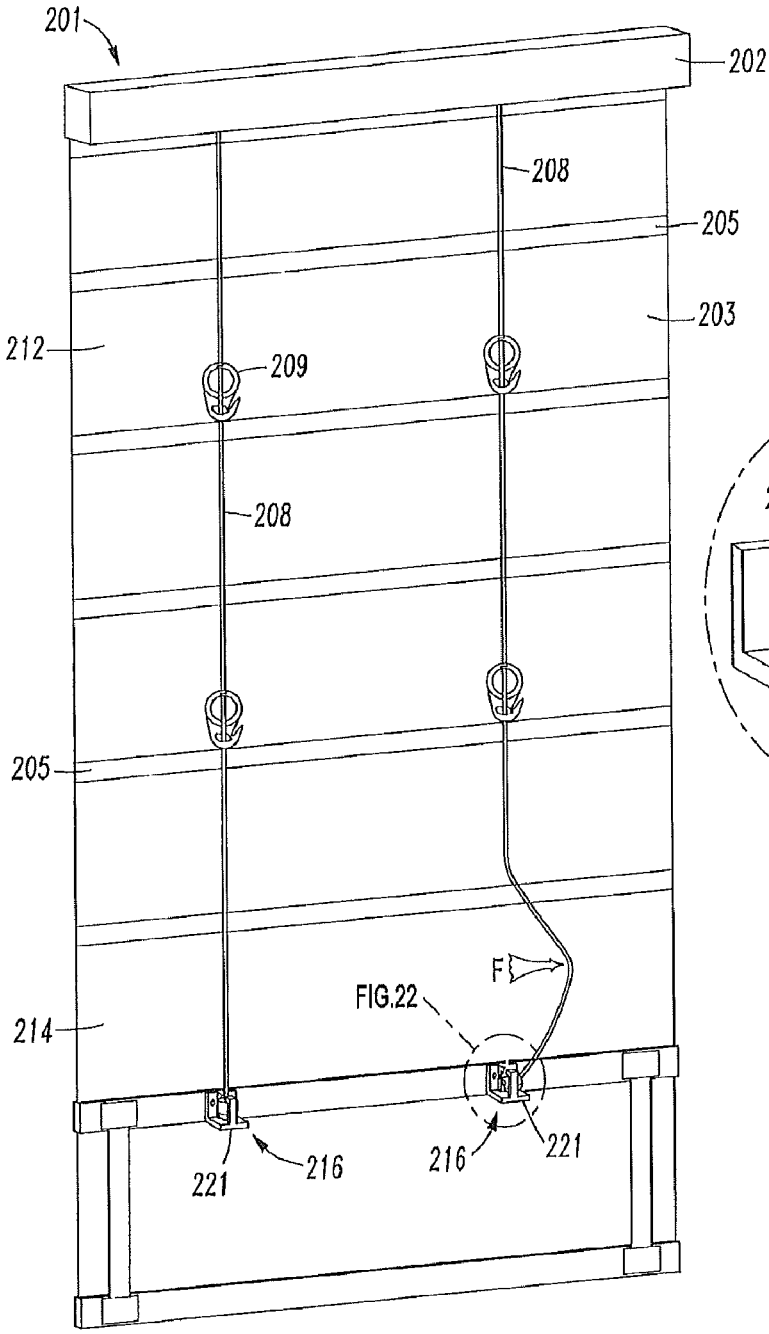
FIG. 21 is a view similar to the view in FIG. 19 of the eighth present preferred embodiment illustrating a release force indicated by arrow F acting on a lift cord and causing a horizontal movement of a male member to separate the male member from a female member.
Figure 22:
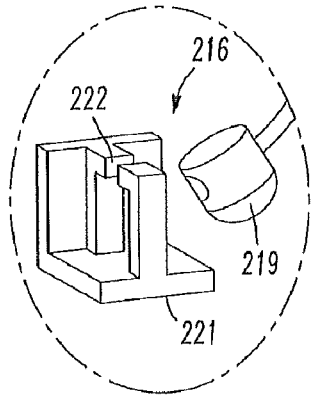
FIG. 22 is a view similar to FIG. 20 illustrating the release of the male member of the safety device from the female member as a result of the release force acting on the lift cord as shown in FIG. 21.
Figures 23, 24:
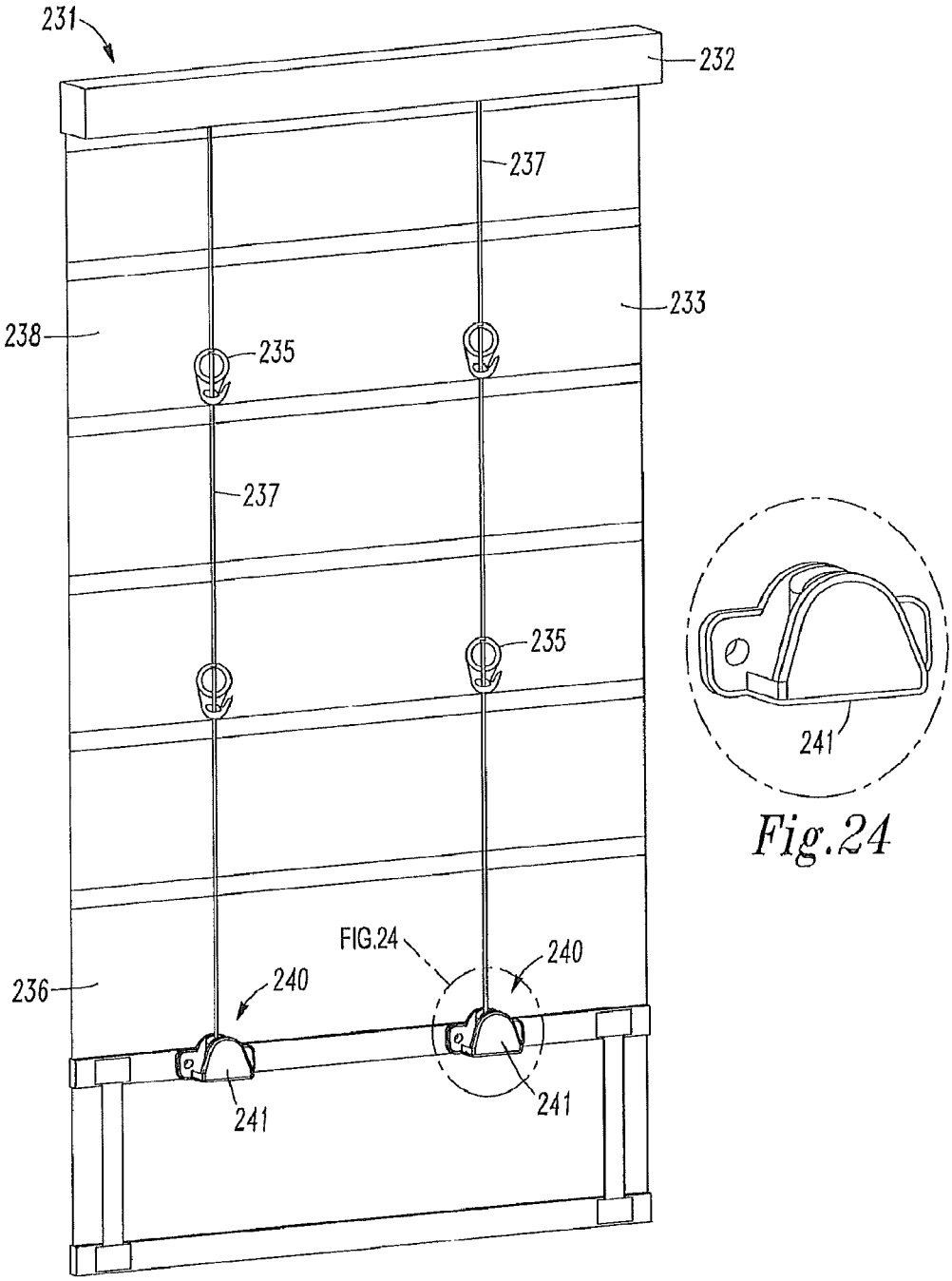
FIG. 23 is a rear perspective view of a ninth present preferred embodiment of my Roman shade.
FIG. 24 is an enlarged view of a present preferred safety device that is used in the ninth present preferred embodiment shown in FIGS. 23 and 25.

As may be appreciated from FIGS. 21 and 22, a child or other person that laterally moves a lift cord while the window covering 201 is mounted may move the lift cord sufficiently to cause a generally horizontal release force to act on the safety device to cause the male member to separate from the female member. The generally horizontal release force causes a generally horizontal movement of the male member 219 away from the opening formed in the female member 221.

It should be appreciated that the generally horizontal release force may be a component of force exerted on the lift cord attached to the male member 219. For instance, a lift cord may be pulled both upwards and sideways such that the force applied to the lift cord includes a generally horizontal component of force that acts on the male member sufficiently to cause the male member to move horizontally and separate from the female member. Preferably, the male and female members are composed of a polymeric material and are configured to permit a release of the male member 219 upon a generally horizontal release force of between four pounds and twenty pounds, or between 4.4 pounds and 6.6 pounds. It is also contemplated that male and female members may be configured such that a generally horizontal release force of less than four pounds may separate the interconnected male and female members.

As may be seen in FIGS. 23-26, another embodiment of my window covering 231 can include safety devices 240. Each safety device 240 includes a female member 241 attached to the lower portion 236 of window covering material 233 that extends from a an upper rail or headrail 232 positioned adjacent to an upper portion 238 of the window covering material 233. A male member 242 is attached to an end of each lift cord 237 that extends from the headrail 232. The male member 242 is sized and configured to pass through openings in cord release devices 235 that are attached to the window covering material 233. The male member 242 is received within an opening formed in the female member 241. The male member 242 is configured to separate from the female member 241 via a generally horizontal movement if a release force, indicated by arrow F in FIG. 25, acts on the lift cord in a direction parallel to the window covering material and perpendicular or substantially perpendicular to the lift cord. Such a release force F may be provided by a child or user pulling a lift cord. It should be understood that the perpendicular and parallel acting release force F may be a component of force exerted by such cord pulling. For instance, a user may pull the lift cord upwards and sideways to create a release force F. The male and female members can be sized and configured such that a release force between five pounds and ten pounds can cause separation of the male and female members. Of course, it is also contemplated that the release force may be much less than five pounds.

Figure 25:
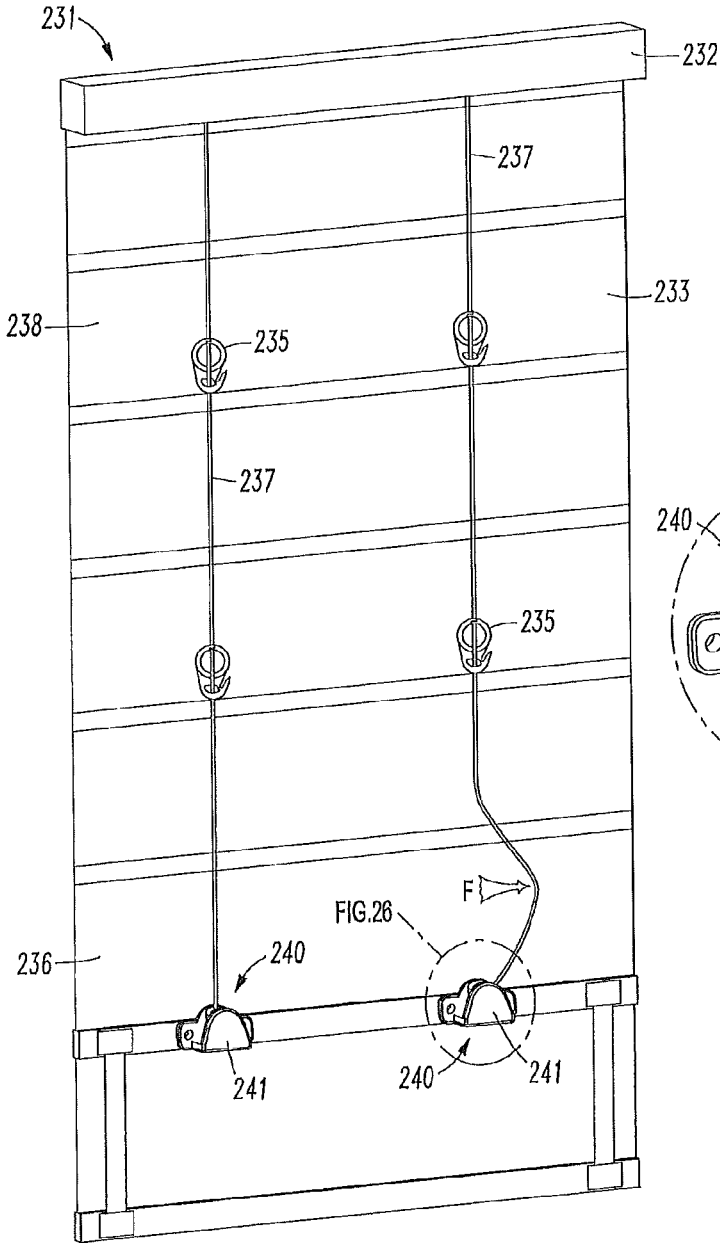
FIG. 25 is a view similar to the view in FIG. 23 of the ninth present preferred embodiment illustrating a release force indicated by arrow F acting on a lift cord and causing a horizontal movement of a male member to separate the male member from a female member.
Figure 26:
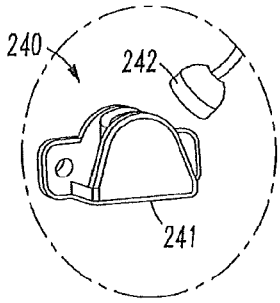
FIG. 26 is a view similar to FIG. 24 illustrating the release of the male member of the safety device from the female member as a result of the release force acting on the lift cord as shown in FIG. 25.
Figure 27:
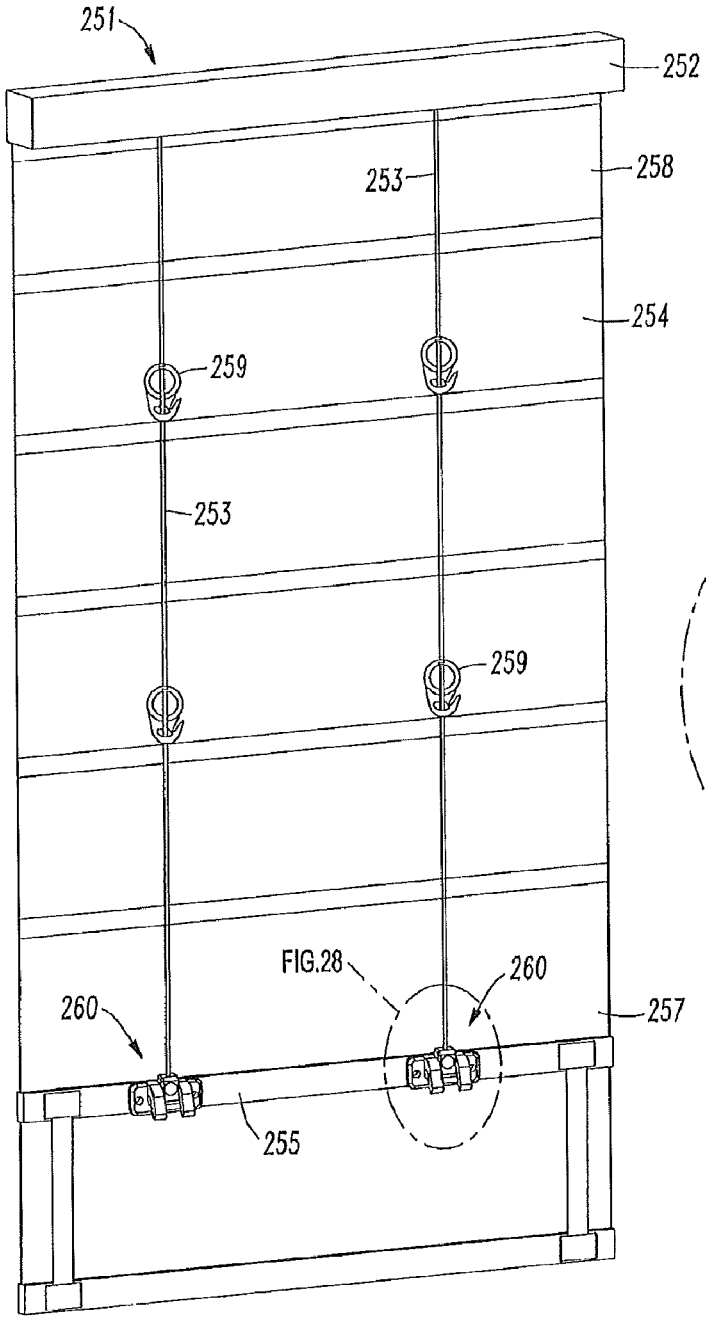
FIG. 27 is a rear perspective view of a tenth present preferred embodiment of my Roman shade.
Figure 28:
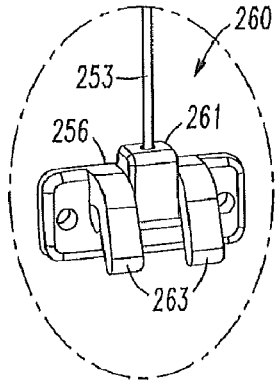
FIG. 28 is an enlarged view of a present preferred safety device that is used in the tenth present preferred embodiment shown in FIGS. 27 and 29.

As may be appreciated from FIGS. 25 and 26, a generally horizontal movement of the male member 241 can cause the male member 242 to release from the female member 241. Such a horizontal movement typically would be caused by a horizontal release force F that acts on the male member via a lift cord. This force may be created by, a small child who becomes entangled within the lift cord causing both longitudinally and laterally forces to act on the lift cord. A movement of the lift cord that includes a lateral component of movement, or a lateral movement, of the lift cord can cause a horizontal release force that is sufficient to separate the male member from the female member when the window covering 231 is mounted adjacent to a window opening.

Other embodiments of my window covering may include safety devices configured to release lift cords upon a downward release force, or downward movement of the lift cord. For instance, an embodiment 251 of my window covering shown in FIGS. 27-30 includes safety devices 260. The male member 261 of each safety device is configured to be releasably attached to the female member 256 of the safety device. Each male member 261 is attached to an end of a lift cord 253 that extends from a headrail 252. The lift cords pass through openings in cord release devices 259 that are attached to window covering material 254. The male members may also be sized and configured to pass through the openings of the cord release devices.

The window covering material 254 has an upper portion 258 adjacent the headrail 252 and a lower portion 257. The window covering material may be extended to a lowered position or retracted to a raised position. A lower rail 255 is attached to the lower portion 257 of the window covering material. The lower rail 255 may be a rod, bar or rail attached to the window covering material or positioned within a pocket formed in the window covering material. In alternative embodiments of my window covering, the lower rail may be the bottom rail of the window covering.

The female member 256 of each safety device 260 is attached to the lower rail 255. The female member has multiple protrusions 263. Each protrusion 263 defines a gap sized and configured to receive a portion of the male member 261. As may best be appreciated from FIGS. 29 and 30, each male member 261 includes projections 264 that extend from opposite sides of the body 265 of the male member 261. For example, the projections 264 may be opposite sides of a rod or bar attached to the body or may be prongs that are formed on opposite sides of the male member.

The protrusions 263 are configured to releasably hold the projections 264 when the window covering 251 is mounted adjacent to a window. When the window covering is mounted, the lift cords are tense and hold the window covering material. The tense, upward force acting on the lift cords to hold the window covering material causes the male members 261 to engage the female members 256 and be retained by the female members 256.

Figure 29:
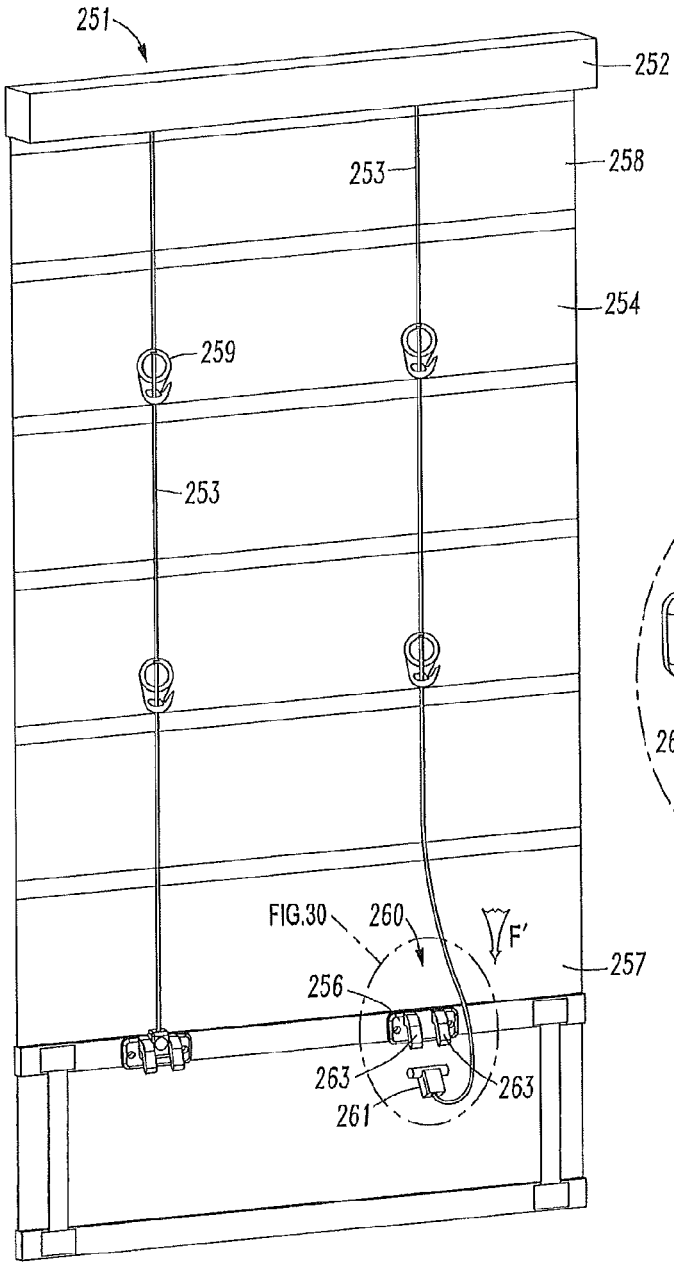
FIG. 29 is a view similar to the view in FIG. 27 of the tenth present preferred embodiment illustrating a generally downward release force indicated by arrow F' acting on the lift cord causing the male member of the safety device to separate from the female member of the safety device.
Figure 30:
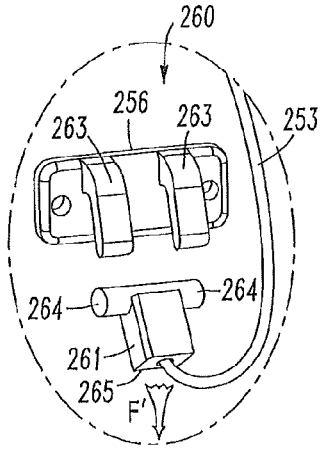
FIG. 30 is a view similar to FIG. 28 illustrating the release of the male member of the safety device from the female member as a result of the release force acting on the lift cord as shown in FIG. 29.
Figure 31:
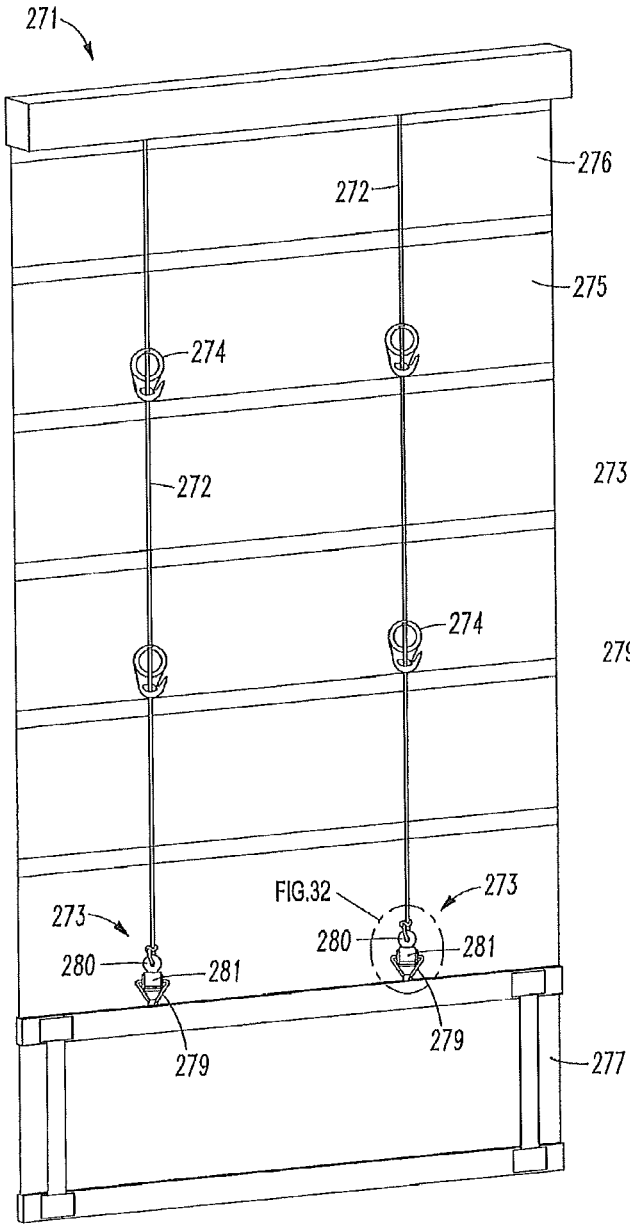
FIG. 31 is a rear perspective view of an eleventh present preferred embodiment of my Roman shade with the window covering material in a fully extended position.
Figure 32:
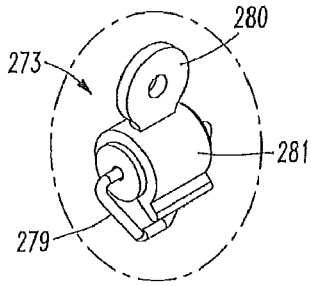
FIG. 32 is an enlarged view of a present preferred safety device that is used in the eleventh present preferred embodiment shown in FIG. 31.
Figure 33:
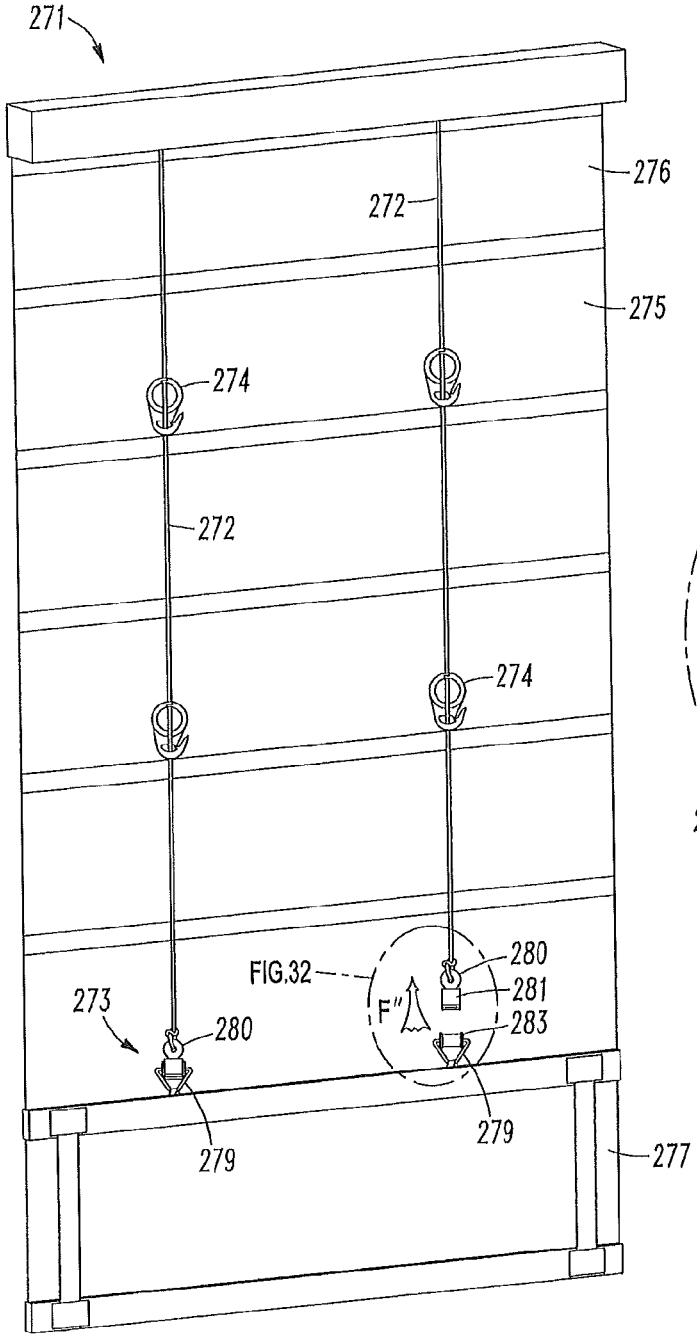
FIG. 33 is a view similar to the view in FIG. 31 of the eleventh present preferred embodiment illustrating a release force indicated by arrow F" causing the male member of the safety device to separate from the female member of the safety device.
Figure 34:
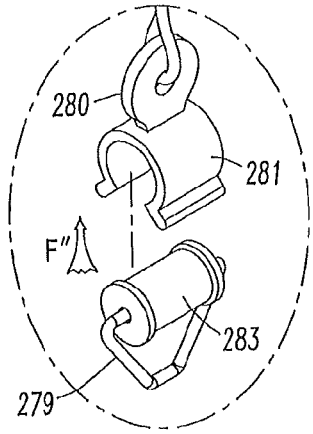
FIG. 34 is a view similar to FIG. 32 illustrating the release of the male member of the safety device from the female member as a result of the release force acting on the lift cord or safety device as shown in FIG. 33.
Figure 35:
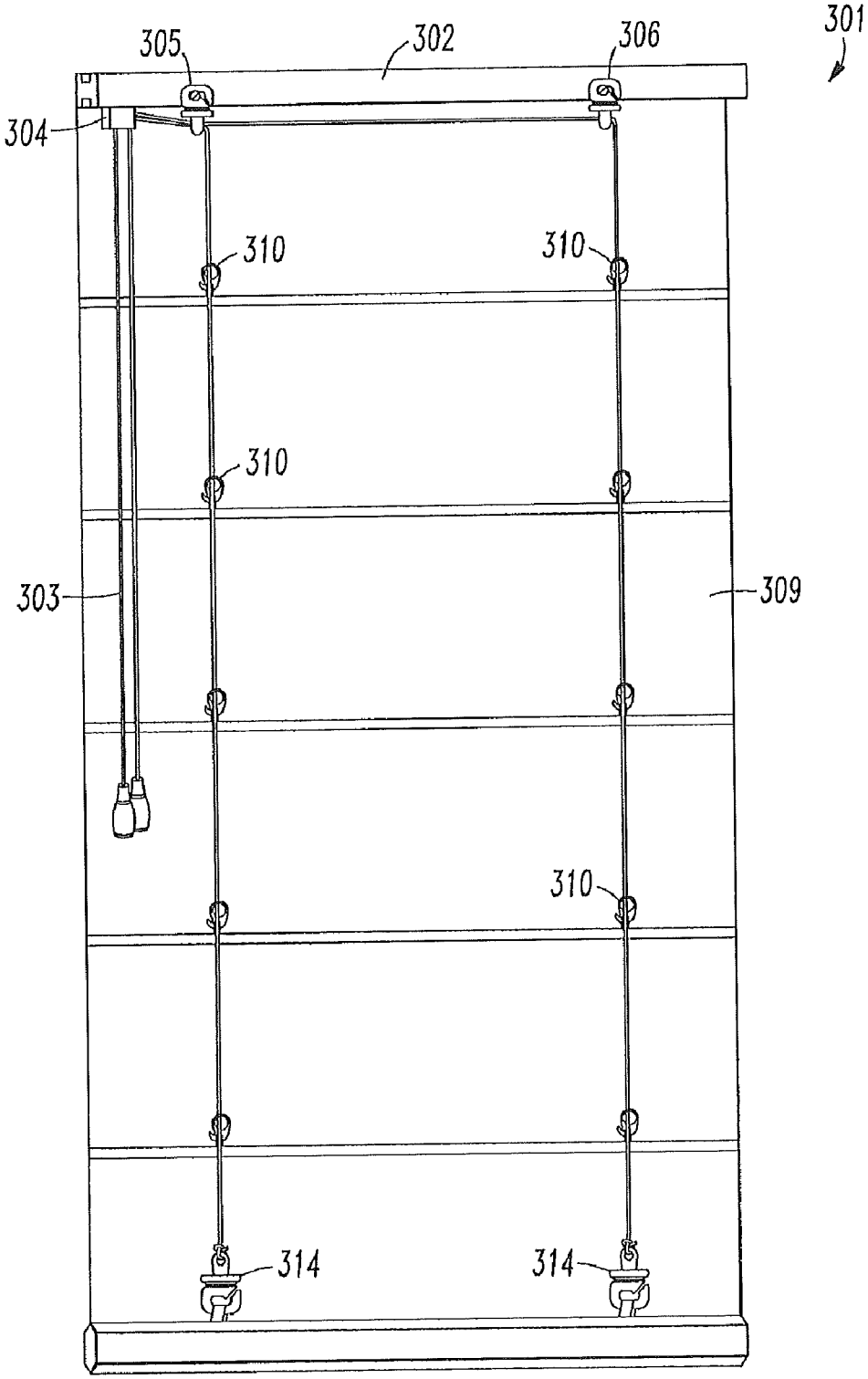
FIG. 35 is a rear perspective view of a twelfth present preferred embodiment of my Roman shade with the window covering material in a fully extended position.
Figure 36:
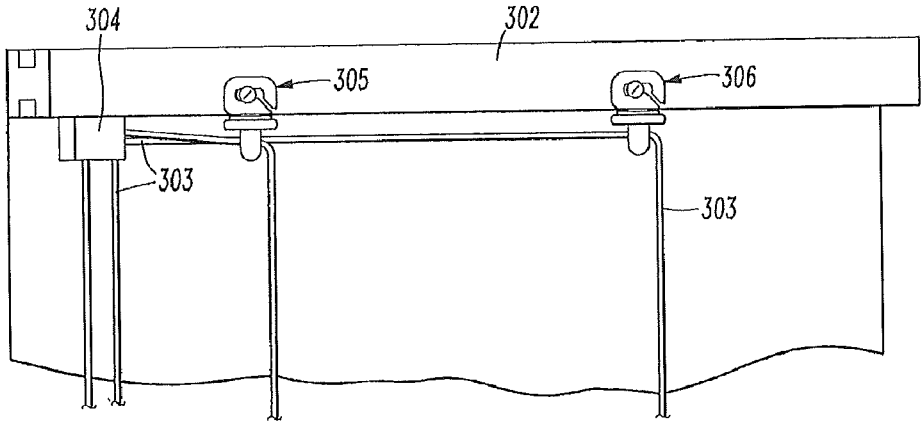
FIG. 36 is an enlarged fragmentary view of the headrail and release devices attached to the headrail of the twelfth present preferred embodiment of my Roman shade.

As may be seen in FIGS. 29 and 30, when the shade is in a fully extended position, or a fully lowered position, a downward release force F' acts on a lift cord 253, the male member 261 attached to that lift cord may be moved away from the female member such that the male member is separated from the female member. Because the shade is fully extended, this release force F' will not cause the window covering material, the lower rail, or the female member 260 attached to the lower rail to move. The separation of the male member attached to the window covering material from the female member prevents the lift cord from holding the window covering material and can also prevent the lift cord from becoming tightly wound about a small child, which can prevent strangulation of a child that may become entangled within the shade.

Preferably, the downward release force F' necessary to cause a male member to separate from a female member is between four and twenty pounds. In this example, it should be understood that the release force is an amount of force that is in addition to the weight of the window covering material and other material that is supported by the lift cord. For example, if a lift cord supports ten pounds of material when a window covering is mounted, the total amount of downward force necessary to release the male member from the female member may be fourteen pounds, which would apply a four pound release force in addition to the weight of the material being supported by that lift cord. As another example, if a child that weighs twenty pounds becomes entangled within a lift cord that supports ten pounds of material of the window covering, the weight of the child may exert a ten pound release force that causes the male member to separate from the female member to release the child and prevent strangulation.

Yet another embodiment of my window covering may be appreciated from FIGS. 31-34. The window covering 271 includes a window covering material 275 that extends from an upper rail. The window covering material 275 has an upper portion 276 and a lower portion 277. Lift cords 272 extend from the upper rail to the window covering material 275. The lift cords 272 pass through openings formed in cord release devices attached to the window covering material 275. Each lift cord 272 has an end portion attached to a female member 280. The female member 280 includes a body 281 that defines an opening sized and configured to receive a male member 279 of a release device 273. The body 281 may define jaws configured to grasp or resiliently hold a male member or may define a mouth sized to receive and releasably hold a male member. The female members 279 are sized to pass through openings in the cord release devices. The female members may also be sized and configured to pass through loops or rings attached to the window covering material.

The male member 279 is attached to the window covering material. The male member 279 includes a body 283 that is sized and configured to be releasably held within the opening of the body 281 of the female member 280. For example, the male member 279 may have a cylindrical or polygonal shaped portion sized and configured to be releasably received within the opening defined in the body 281 of the female member 280.

The body 281 of the female member 280 is sized and configured to release the male member 279 attached to the window covering material when an upward release force acts on the female member 280. For instance, if a person applies an upward release force of five pounds, the female member 280 may be configured to release the male member 279. As another example, if the lift cord to which a male member is attached holds ten pounds of material when the window covering is mounted, a person may cause the female member 280 to release the male member 279 by providing a generally upward force of five pounds or two pounds to the female member 280 or the lift cord attached to the female member 280. It should be appreciated that such a force may be applied by pulling the female member 280 away from the male member 279.

The separation of the male and female members may prevent a child from becoming tightly entangled within the loose lift cord. The male member may also release from the female member when a release force, such as the force indicated by arrow F" in FIG. 33, acts on the lift cord in a direction parallel to the window covering material and generally parallel to the lift cord. That release force F" will cause vertical movement of the female member 281 away from the male member 279.

It should be understood that the lift cords 272 may be two ends of only one cord. A middle portion of the cord (not shown) may be attached to a lift mechanism (not shown), such as a spring motor, positioned in the upper rail. The opposite ends of that cord may extend from the middle portion to the window covering material adjacent opposite sides of the window covering material to hold the window covering material in a selected position when the window covering is mounted adjacent to a window opening.

Referring to FIGS. 35-39, another present preferred embodiment of my Roman shade 301 may also include cord release devices 305 and 306 attached to the headrail 302 of the Roman shade 301. Lift cords 303 may extend through a cord lock 304 attached to the headrail 302 and pass through a portion of the release devices 305 and 306. Each lift cord may pass from a respective release device that is attached to the headrail 302 and extend through cord release devices 310 attached to the shade material 309 of the shade 301. The cord release devices 310 may operate similarly to the cord release devices 142 discussed above and shown in FIGS. 16-18. Alternatively, the lift cords may pass through rings or loops attached to the shade material.

Each lift cord may terminate at a safety release device 314 attached to a bottom segment of the shade material 309. The safety release device 314 may include a male member attached to an end portion of a lift cord and a female portion attached to the shade material similar to the safety devices discussed above, such as safety device 59.

Figure 37:
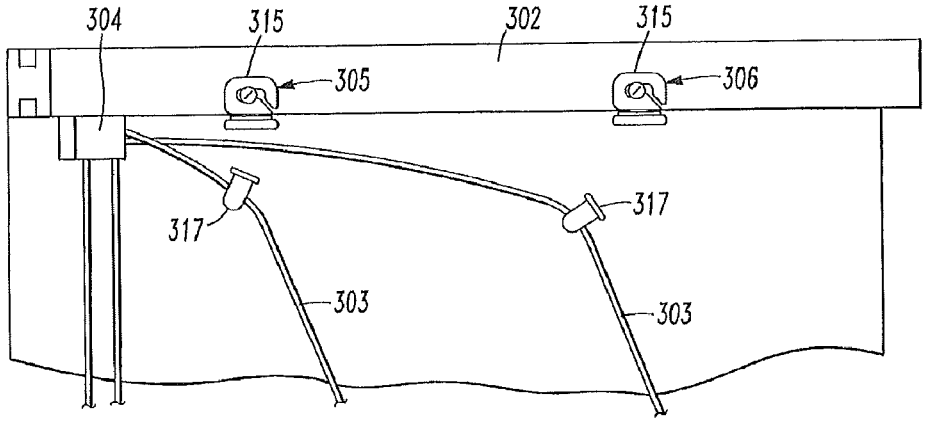
FIG. 37 is a view similar to FIG. 36 of the twelfth present preferred embodiment of my Roman shade with the release devices attached to the headrail of the Roman shade in a released position.
Figure 38:
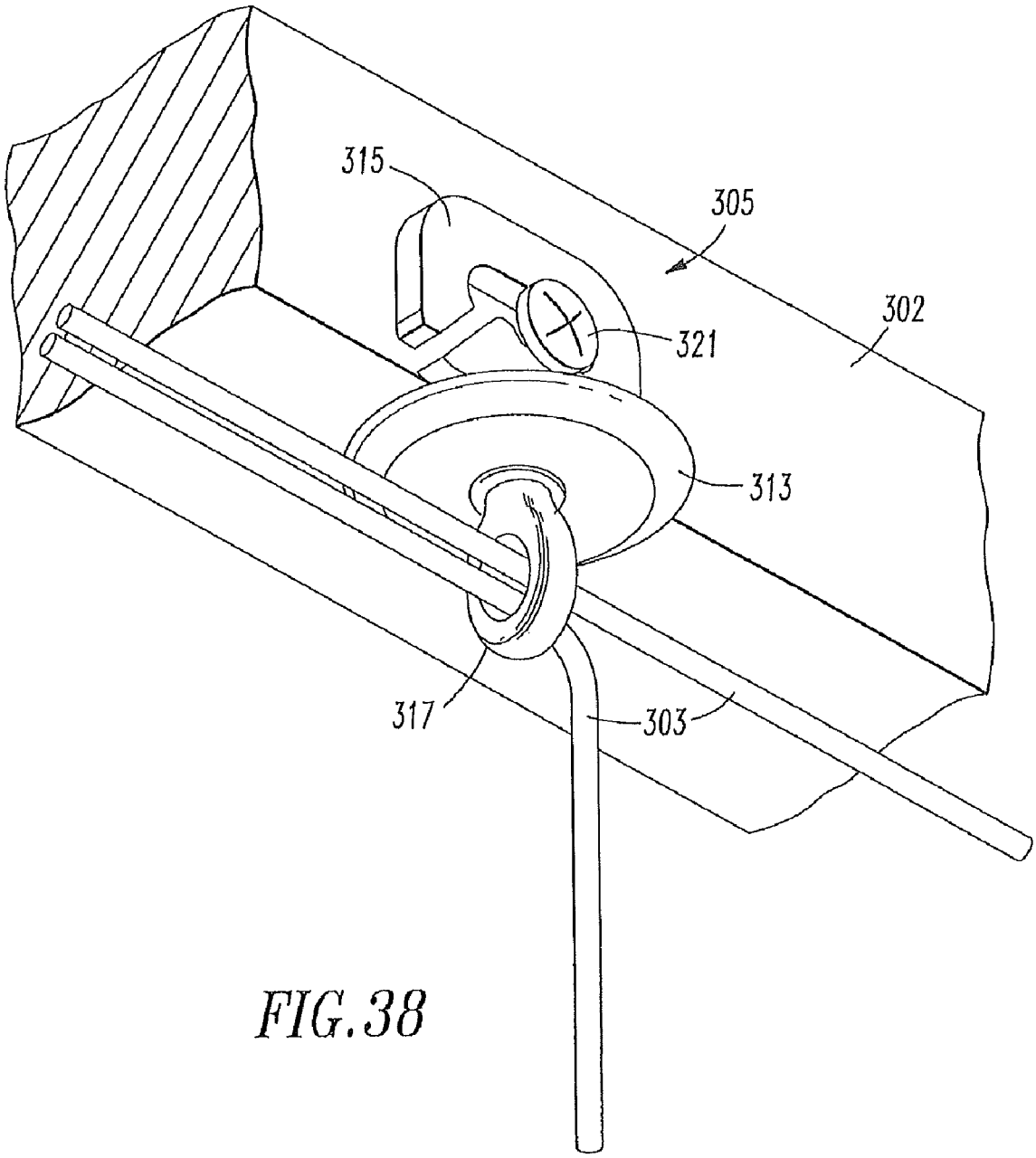
FIG. 38 is an enlarged fragmentary view of a first present preferred release device attached to the headrail of the twelfth present preferred embodiment of my Roman shade.
Figure 39:
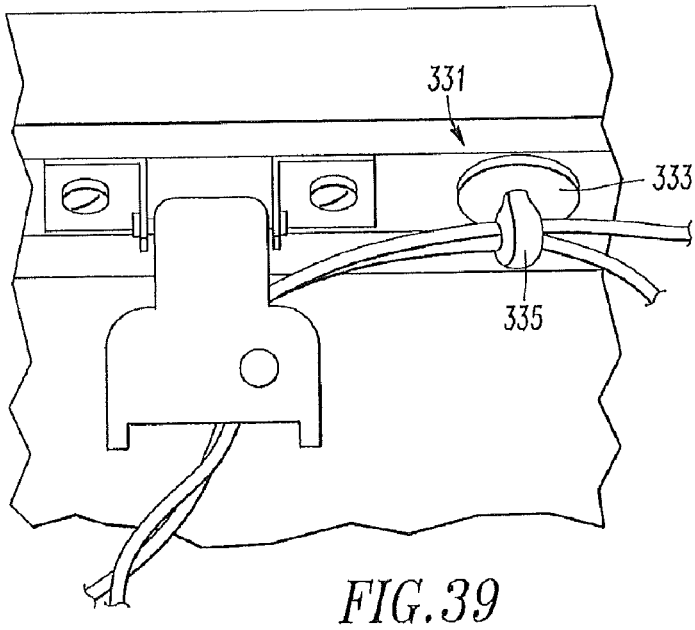
FIG. 39 is an enlarged fragmentary view of a second present preferred release device attached to the headrail of the twelfth present preferred embodiment of my Roman shade.

As may be appreciated from FIGS. 37-39, the release devices attached to the headrail, may include a first release device 305 and a second release device 306. Each release device attached to the headrail 302 may include an attachment portion 315 sized and configured for attachment to the headrail 302. For example, the attachment portion 315 may be a hook sized and configured to connect to a portion of a screw or fastener attached to the headrail or may be configured to attach to a portion of the headrail. The attachment portion 315 may be attached to a female portion 313 that has an opening sized and configured to releasably receive a male portion 317. Preferably, the opening has a spring positioned therein, such as a coil spring, a serpentine spring, an S-shaped spring, or other resilient member configured to releasably attach the male member 317 within the opening of the female portion. It is also contemplated that a spring positioned in the opening of the female member can have two spaced apart, substantially parallel portions that are positionable between the male portion 317 to hold the male portion 317. The arms of the spring could be configured to move away from one another to receive or release the male portion 317.

The male portion 317 is sized and configured to release from the opening of the female portion 313 after a downward release force acts on the male portion 317. For example, each release device 305, 306 attached to the headrail may be configured such that the male portion 317 of the device releases after a downward release force between three and ten pounds acts on the male portion via the lift cord 303 passing through the male portion 317.

Figure 14:
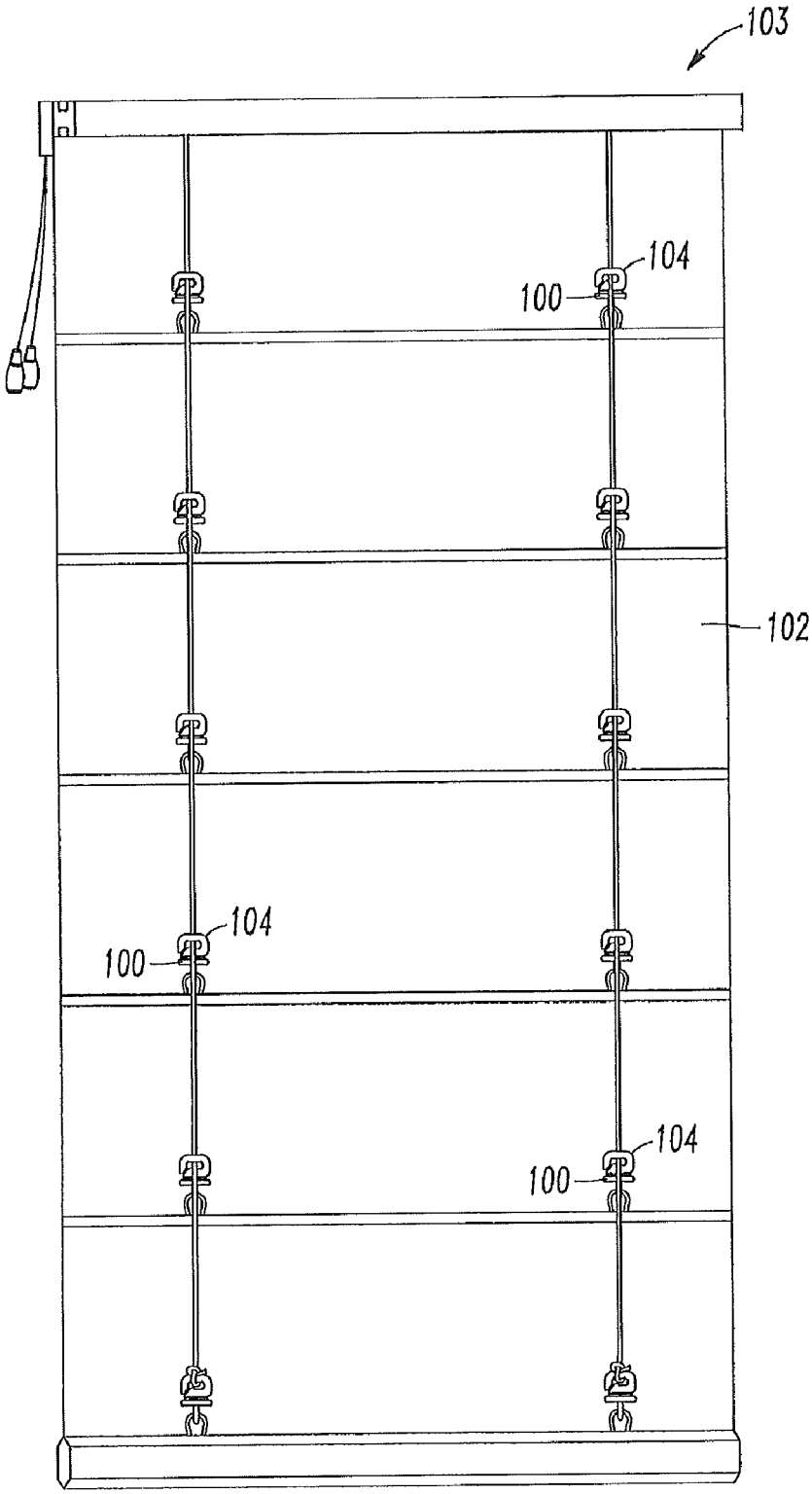
FIG. 14 is a rear view of a fifth present preferred embodiment of my Roman shade.

Alternatively, release devices similar attached to the headrail may be configured similarly to the release devices shown in FIG. 14 such that the male portion is attached to the headrail. The female members may then be configured to releasably interlock or connect with the male portion. For such release devices, the lift cords would pass through an opening in the female member and the male portions could include an attachment portion to attach to the headrail.

It is also contemplated that release devices 331 could be attached to the headrail. Such release devices may include a female portion 333 that is configured to be attached within an opening in the headrail of a shade. The male portion 335 of the device 331 may have a hole sized and configured to permit at least one of the lift cords to pass through that male portion. Preferably, the opening in the male member is sized to permit all the lift cords to pass through the male portion. The male portion is sized and configured to release from the female portion 333 after a release force acts on the male portion.

It should be understood that the use of both release devices attached to the headrail of a shade as discussed above can prevent the lift cords from being pulled to form loops adjacent to the headrail, which can prevent small children from becoming entangled within the lift cords adjacent to the headrail. The use of the headrail release devices in combination with the bottom release devices 314 can also provide a shade that prevents loops from forming adjacent the bottom, middle, or top portions of the shade material to avoid child entanglement or strangulation.

Embodiments of my safety kit and embodiments of my Roman shade can provide a Roman shade that includes one or more safety devices that can prevent child entanglement within the lift cords of the shade. The safety kits preferably include both release devices and cord release devices that are provided on the back of the shade so they do not detract from the aesthetic effect provided by the front of the shade. Further, the safety devices can be sized to be relatively small so they are not readily apparent to a typical homeowner from the rear of the shade. As a result, the safety devices may not detract from the aesthetic effect provided by the rear of the shade, which may be seen through a window.

It should be appreciated that other variations of the present preferred embodiments discussed above may be made. For example, the number of lift cords required for any particular Roman shade can vary according to the size and weight of the shade material as well as the release force required to separate the cord release device attached to the shade. As another example, safety devices may include male members that have mateable bodies of different shapes or sizes than those described above. As yet another example, the safety devices may also include female members that have receptacles that are configured for releasable connection to the male members that have different sizes or shapes than those described above.

While certain present preferred embodiments of my Roman shade and certain embodiments of methods of practicing the same have been shown and described, it is to be distinctly understood that the invention is not limited thereto but may be otherwise variously embodied and practiced within the scope of the following claims.

I claim:

1. A window covering comprising:

an upper rail;

window covering material adjacent to the upper rail, the window covering material moveable from a retracted position to an extended position, the window covering material having an upper portion and a lower portion;

a plurality of lift cords extending from the upper rail to the window covering material; and a plurality of first safety devices attached to the upper rail, each first safety device comprised of a male member and a female member, one of the male member and the female member of each first safety device attached to the upper rail and the other member being attached to a respective lift cord such that that member is attachable to the member attached to the upper rail, the male member and the female member of each first safety device sized and configured such that a first release force acting on the lift cord causes the male and female members to separate;

a plurality of second safety devices, each second safety device comprised of a male member and a female member, one of the male member and the female member of each second safety device attached adjacent to the lower portion of the window covering material and the other member being attached to a respective lift cord such that that member is attachable to the member attached adjacent to the lower portion of the window covering material, the male member and the female member of each second safety device sized and configured such that a second release force acting on the lift cord causes the male member and female member to separate.

2. The window covering of claim 1 wherein the female member of each second safety device is attached to the lower portion of the window covering material and the male member of each safety device is attached to a respective lift cord.

3. The window covering of claim 2 wherein the female member of each second safety device is attached to the lower portion of the window covering material, the female member of each second safety device being comprised of a body that defines an opening configured to permit a release of the male member via the second release force, the second release force acting in a generally upward direction.

4. The window covering of claim 3 wherein the body also defines a gap positioned above the opening, the gap sized and configured to receive a portion of a lift cord.

5. The window covering of claim 1 wherein the plurality of lift cords is comprised of a first lift cord and a second lift cord.

6. The window covering of claim 1 further comprising a lower rail attached to the lift cords adjacent to the lower portion of the window covering material.

7. The window covering of claim 6 wherein each member of each second safety device attached adjacent to the lower portion of the window covering material is attached to the lower rail.

8. The window covering of claim 1 further comprising at least one cord release device attached to the window covering material, each cord release device comprised of a clip portion, a first member and a second member, the clip portion attached to the first member and the second member, the first member and second member sized and configured to abut each other or releasably interconnect such that the first and second members at least partially define an opening sized to receive and releasably retain at least one lift cord when the first and second members are interconnected or abutting each other and the first and second members being configured to separate and release the at least one lift cord when a third release force exerted by at least one lift cord that is within the opening acts on at least one of the first and second members.

9. The window covering of claim 8 wherein the first and second members of the at least one cord release device are configured to move away from each other in a direction that is transverse or perpendicular to the window covering material when the third release force acts on at least one of the first and second members.

10. The window covering of claim 8 wherein the first and second members of the at least one cord release device and the clip portion of the at least one cord release device are comprised of a polymeric material and are integrally molded together.

11. The window covering of claim 8 wherein the window covering material is comprised of woven wood or woven grass that is collected into segments, each segment having a plurality of flexible elongated members that hold the woven wood or woven grass in that segment, and wherein the clip portion of the at least one cord release device is attached to one of the flexible elongated members.

12. The window covering of claim 8 wherein the first release force acts generally downwardly and the second release force acts generally downwardly.

13. The window covering of claim 1 wherein at least one of the first and second release force is between 2 pounds and 6.6 pounds.

14. The window covering of claim 1 wherein the female member of each second safety device is attached adjacent to the lower portion of the window covering material and the male member of each second safety device is attached to a respective lift cord.

15. The window covering of claim 1 wherein the female member of each first safety device is attached to the upper rail and the male member of each first safety device is attached to at least one lift cord.

16. The window covering of claim 15 wherein the female member of each first safety device is comprised of a body that has an opening and a spring positioned within the opening.

17. The window covering of claim 15 wherein the first release force acts generally downwardly such that the male member moves downward relative to the female member of each first safety device to separate.

18. The window covering of claim 17 wherein the female member of each second safety device is attached to the window covering material and wherein the second release force acts generally downwardly such that the female member of each second safety device moves downward relative to the male member of each second safety device to separate.

19. The window covering of claim 1 wherein the upper rail is a headrail.

20. The window covering of claim 19 further comprising a bottom rail attached to the lift cords adjacent to the lower portion of the window covering material.

* * * * *